US006644263B2

(12) United States Patent
Hare

(10) Patent No.: US 6,644,263 B2
(45) Date of Patent: Nov. 11, 2003

(54) ENGINE WITH DRY SUMP LUBRICATION

(76) Inventor: Nicholas S. Hare, 177 Pineville Rd., Monroeville, AL (US) 36460

( * ) Notice: Subject to any disclaimer, the term of this patent is extended or adjusted under 35 U.S.C. 154(b) by 0 days.

(21) Appl. No.: 10/266,728

(22) Filed: Nov. 26, 2002

(65) Prior Publication Data

US 2003/0101959 A1 Jun. 5, 2003

Related U.S. Application Data

(60) Provisional application No. 60/337,061, filed on Dec. 4, 2001.

(51) Int. Cl.[7] ..... F01M 1/00; F01B 31/10

(52) U.S. Cl. ..... 123/196 R; 123/193.6; 92/153

(58) Field of Search ..... 123/193.4, 193.6, 123/196 R; 92/153, 157, 160

(56) References Cited

U.S. PATENT DOCUMENTS

| | | | | | |
|---|---|---|---|---|---|
| 872,622 | A | | 12/1907 | Hagadorn | |
| 920,165 | A | | 5/1909 | Marcil | |
| 934,125 | A | | 9/1909 | Young | |
| 1,096,819 | A | | 5/1914 | Ahlberg | |
| 1,136,715 | A | | 4/1915 | Pitts | |
| 1,486,110 | A | | 3/1924 | Hack | |
| 1,569,030 | A | | 1/1926 | Randall | |
| 1,582,195 | A | | 4/1926 | Vallier | |
| 1,600,210 | A | | 9/1926 | Ashton | |
| 1,791,971 | A | | 2/1931 | Penick et al. | |
| 1,793,444 | A | | 2/1931 | Johnson | |
| 1,895,728 | A | | 1/1933 | Pippin | |
| 1,925,851 | A | | 9/1933 | Spencer | 123/76 |
| 1,949,612 | A | | 3/1934 | Mattair et al. | 309/6 |
| 1,972,732 | A | | 9/1934 | Farmer | 184/18 |
| 2,503,642 | A | | 4/1950 | Tilliet | 123/65 |
| 2,801,140 | A | | 7/1957 | Kretzer | 309/23 |
| 2,814,282 | A | | 11/1957 | Gross | 123/73 |
| 2,852,097 | A | | 9/1958 | Proctor | 184/18 |
| 2,937,631 | A | | 5/1960 | Coyle | 123/75 |
| 3,136,306 | A | * | 6/1964 | Kamm | 123/41.38 |
| 3,810,640 | A | * | 5/1974 | Ahlen | 277/579 |
| 3,844,109 | A | | 10/1974 | Roos | 60/39.6 |
| 3,905,341 | A | | 9/1975 | Boyesen | 123/73 R |
| 3,973,532 | A | | 8/1976 | Litz | 123/75 CC |
| 4,248,185 | A | | 2/1981 | Jaulmes | 123/73 R |
| 4,250,844 | A | | 2/1981 | Tews | 123/73 AV |
| 4,280,455 | A | | 7/1981 | Yamaguchi et al. | 123/196 M |
| 4,290,511 | A | | 9/1981 | de Baan et al. | |
| 4,294,202 | A | | 10/1981 | Boyesen | 123/73 PP |
| 4,321,893 | A | | 3/1982 | Yamamoto | 123/65 PE |
| 4,364,307 | A | | 12/1982 | Paro | 92/157 |
| 4,388,895 | A | | 6/1983 | Boyesen | 123/73 PP |
| 4,395,978 | A | | 8/1983 | Boyesen | 123/73 R |
| 4,432,925 | A | * | 2/1984 | Holtzberg et al. | 264/235 |
| 4,481,910 | A | | 11/1984 | Sheaffer | 123/73 R |
| 4,481,917 | A | | 11/1984 | Rus et al. | 123/190 C |
| 4,598,673 | A | | 7/1986 | Poehlman | 123/73 PP |
| 4,630,591 | A | | 12/1986 | Hooper | 123/73 PP |
| 4,829,946 | A | | 5/1989 | Boyesen | 123/65 PE |
| 4,909,193 | A | | 3/1990 | Boyesen | 123/65 PE |
| 4,911,115 | A | | 3/1990 | Boyesen | 123/65 PE |
| 4,924,819 | A | | 5/1990 | Boyesen | 123/65 PE |
| 5,002,025 | A | | 3/1991 | Crouse | 123/196 M |
| 5,396,867 | A | | 3/1995 | Ito et al. | 123/41.39 |
| 5,513,608 | A | | 5/1996 | Takashima et al. | 123/196 W |

(List continued on next page.)

OTHER PUBLICATIONS

SAE Paper No. 700124 entitled, "*Parametric Studies Using a Two–Stroke Engine Cycle Simulation*" by Sathe, dated Jan. 12–16, 1970 (pp. 1–12).

SAE Paper entitled "*Design and Simulation of Two–Stroke Engines*" by Blair, copyright 1996, Chapter 5, entitled "Computer Modeling of Engines" (pp. 363–370).

SAE Paper No. 920779 entitled "*Two–Stroke Engines—The Lotus Approach*" by Blundell et al, dated Feb. 24–28, 1992 (pp. 185–195).

SAE Technical Paper Series 850183 entitled "*Improvement of Fuel Consumption with Variable Exhaust Port Timing In a Two–Stroke Engine*" by Nomura et al., dated Feb. 25–Mar. 1, 1985 (pp. 1–10).

SAE Paper No. 730815 entitled "*Exhuast Port Shapes for Sound and Power*" by Johnston, dated Sep. 10–13, 1973 (pp. 1–10).

Popular Science (Feb. 1987) entitled "*Can the two–stroke make it this time?*" by Scott (pp. 74–76).

Popular Science (May 1999) article entitled "*ENGINES Two Strokes on Two Wheels*" by Carney (p. 45).

Popular Mechanics (Oct. 1999) articled entitled "*Outdoors Putting On The Pressure*" by Gromer (pp. 48 and 50).

"*Merc's All–New, Direct–Injected Outboard*" by Barron, copyright 1996 (6 pp.).

*Quick Take: Honda EXP–2*, [online] [Retrieved on Sep. 30, 2002] Retrieved from the Internet using <URL http://www.motorcycle.com/momchonda/exp2.html.

*Honda EXP–2*, [online] [Retrieved on Sep. 30, 2002] Retrieved from the Internet using <URL http://www.motorcycle.com/mo/mchonda/exp_tech.html.

*Primary Examiner*—Noah P. Kamen
(74) *Attorney, Agent, or Firm*—Synnestvedt & Lechner LLP

(57) ABSTRACT

An internal combustion engine having an improved lubrication system. Upper and lower seals are mounted around the piston to define an annular oil chamber in cooperation with the piston and the cylinder. For four-cycle engines, a compression ring may act as the upper seal. In two-cycle engines, upper and lower seals are provided in addition to any compression rings. The annular oil chamber is connected by conduits to an oil reservoir. A pump circulates oil through the annular oil chamber to lubricate at least the cylinder and piston. Conduits adjoining the annular oil chamber may be provided to lubricate the wrist pin, piston rod, crank bearing and/or main bearing. Accordingly, the reservoir may be segregated from the crankcase, resulting in a reduction in noxious emissions due to oil combustion.

32 Claims, 17 Drawing Sheets

U.S. PATENT DOCUMENTS

| | | | | |
|---|---|---|---|---|
| 5,572,967 | A | 11/1996 | Donaldson, Jr. | 123/190.12 |
| 5,638,780 | A | 6/1997 | Duvinage et al. | 123/65 VA |
| 5,755,194 | A | 5/1998 | Moorman et al. | 123/196 W |
| 5,983,851 | A | 11/1999 | Kimijima et al. | 123/196 W |
| 6,085,703 | A | 7/2000 | Noguchi | 123/73 R |
| 6,112,708 | A | 9/2000 | Sawada et al. | 123/73 R |
| 6,152,093 | A | 11/2000 | Sawada et al. | 123/73 PP |
| 6,216,650 | B1 | 4/2001 | Noguchi | 123/73 A |
| 6,240,886 | B1 | 6/2001 | Noguchi | 123/732 |
| 6,289,856 | B1 | 9/2001 | Noguchi | 123/73 PP |

* cited by examiner

FIG.15A
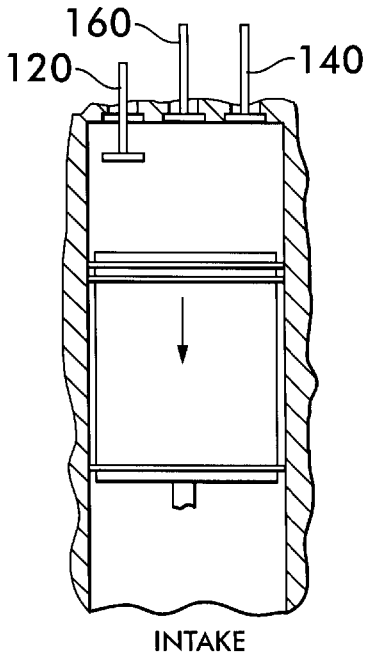
FIG.15B
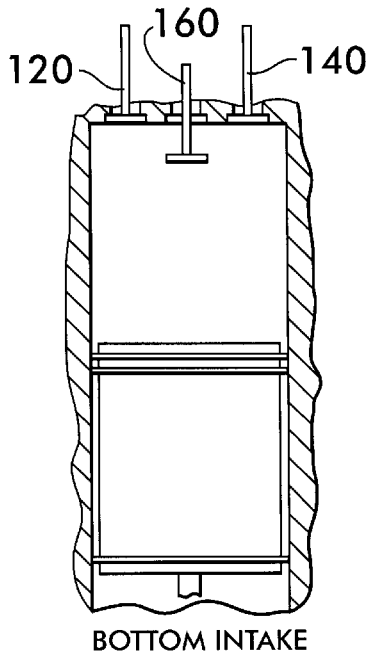
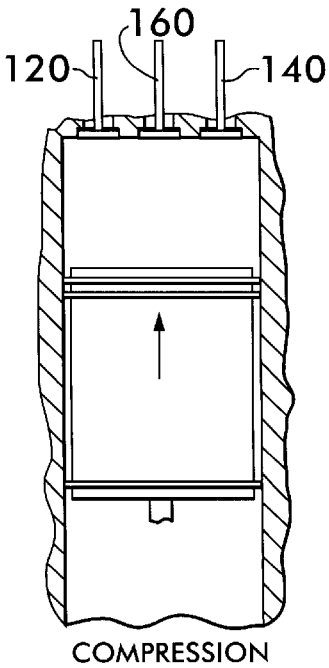
FIG.15C
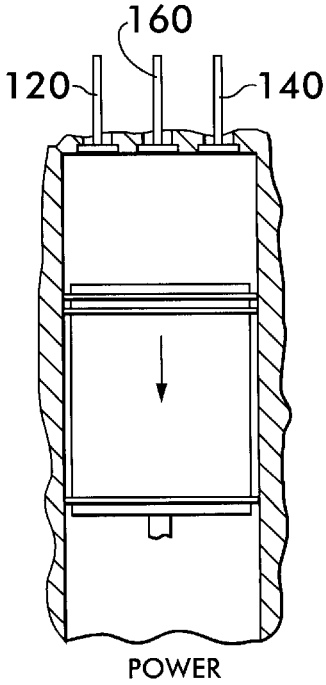
FIG.15D
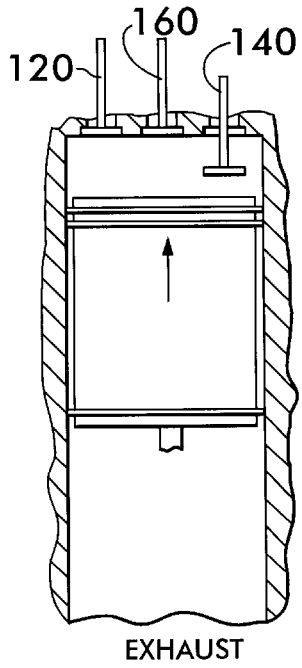
FIG.15E

ENGINE WITH DRY SUMP LUBRICATION

RELATED APPLICATIONS

This application claims the benefit of U.S. Provisional Patent Application No. 60/337,061, filed Dec. 4, 2001, the entire disclosure of which is hereby incorporated herein by reference.

FIELD OF THE INVENTION

The present invention relates generally to internal combustion engines, and particularly to two-stroke and four-stroke engines having an improved lubrication system capable of reducing polluting emissions.

BACKGROUND OF THE INVENTION

The present invention recognizes the global need for reduced hydrocarbon emissions from small power-producing engines, especially as relates to the rapidly growing demand for agricultural and light industrial power in developing economies. In these economies, the low weight and low cost of two-stroke engines will be difficult to ignore, and it may be expected that two-stroke engines will be widely used. Two-stroke engines produce high levels of unburned hydrocarbon emissions, since, due to their operating principle, exhaust gases are expelled from the engine's cylinder at the same time that a fresh fuel/air charge is brought in, leading inevitably to mixing between the two and the inadvertent expulsion of unburned charge with the exhaust gases.

Furthermore, two-stroke engines pass their fuel/air charge through the crankcase to allow a slight pressurization of the charge, caused by the descent of the piston, to assist the flow of charge into the cylinder. As it passes through the crankcase, the charge entrains lubricating oil droplets, which are splashed on the crankshaft main bearing and connection rod (crank) bearing and sprayed on the cylinder walls and wrist pin. Alternately, oil is mixed with the fresh charge before entering the crankcase, in which case the charge is used as an agent for transporting oil to the engine surfaces requiring lubrication. Lubricating oil entrained in the charge is inducted into the cylinder, where it either flows through into the exhaust, creating more unburned hydrocarbon emission, or remains in the cylinder where it is burned, creating a more noxious set of pollutants than would stem from the combustion of the engine fuel itself.

The pollution disadvantages of conventional two-stroke, spark-ignited engines (overlap of intake and exhaust flows and crankcase charge compression) lead to its advantages in day-to-day applications. Since the exhaust and intake strokes are not separate, for a given requirement for engine power and speed, at a gas constant compression ratio, a two-stroke engine requires only half the displacement of a four-stroke engine. The weight of the two-stroke engine is also a little more than half of the weight of a power-equivalent four-stroke engine and cost much less to produce. These advantages will prove very difficult to ignore in a developing economy, and thus, if two-stroke engines retain their conventional form, there is a great potential for globally significant increases in engine-related air pollution.

The present invention retains the engine size advantage of the two-stroke engine, the cost advantage of the carbureted two-stroke engine and reduces its unburned hydrocarbon emissions and lubricating oil combustion characteristics to levels comparable with the most advanced direct injected, two-stroke, dry-sump engines. This is accomplished with a relatively minor increase in cost for the inclusion of new parts and new machined or cast features on conventional parts. These parts and features provide an improved two-stroke, spark-ignited engine capable of operating with very little unburned fuel emission and with very little lubricating oil combustion. The present invention is also applicable to four-stroke spark-ignition engines and compression-ignition engines such as diesel engines.

SUMMARY OF THE INVENTION

Nearly complete reduction in lubricating oil combustion in two-stroke engines is achieved by the present invention by using a novel system for dry-sump lubrication. The novel lubrication system is also applicable to four-stroke engines and provides various advantages, including the ability to operate the engine in any attitude or orientation and can provide supercharging at little added cost. In accordance with the present invention, the piston is provided with upper and lower seals defining an annular oil chamber in cooperation with the body of the piston and an adjacent portion of the cylinder wall as the piston is reciprocated within the cylinder. If necessary, an oil sleeve may be added between the cylinder and crankcase to effectively extend the cylinder wall to ensure that an annular oil chamber is defined along the desired length of the piston's stroke.

The lower seal substantially prevents any oil within the annular oil chamber from flowing into the crankcase. Optionally, a small, controlled amount of oil is allowed to escape past the upper seal, into the upper portion of the cylinder, in order to lubricate the compression rings and then be consumed, as is normal practice in engine design. The remainder of the oil is circulated through the annular oil chamber to lubricate the cylinder, piston, compression and/or oil control rings, and/or seals. Depending upon the position of the seals, the annular oil chamber may also lubricate the wrist pin. Where desired, oil conduits or passages in the body of the piston may connect the wrist pin area with the oil chamber. Optionally, a system of sealed passages or conduits leading to and/or from the annular oil chamber may be provided to lubricate bearings in the crankcase. Oil from a reservoir is circulated through the annular oil chamber and/or the conduits by a pump. Because the oil reservoir is segregated from the crankcase by seals, the crankcase remains dry.

In its preferred embodiment, the invention concerns an internal combustion engine having a piston reciprocable within a bore of a cylinder. The piston is pivotally connected to a crankshaft by a piston rod having at one end a wrist pin engaging the piston and at an opposite end a crank bearing engaging a throw of the crankshaft. The crankshaft is rotatably mounted on a main bearing within a crankcase positioned beneath the cylinder bore.

A first seal is mounted on and circumferentially around the piston to define an upper end of the annular oil chamber. The first seal has an outer circumference engaging the cylinder to limit any oil flowing from the annular oil chamber to the cylinder bore for lubricating the cylinder.

A second seal is mounted on and circumferentially around the piston to define a lower end of the annular oil chamber. The second seal has an outer circumference engaging the cylinder to substantially prevent any oil within said annular oil chamber from flowing into the crankcase.

Upon motion of the piston within the cylinder bore, the first and second seals and the annular oil chamber move with the piston. At least a portion of any oil within the annular oil chamber is thereby carried with the piston to lubricate the cylinder, piston, compression and/or oil control rings, and/or seals.

In a conventional two-stroke engine, oil is either broadcast as a spray throughout the crankcase or inducted as a mist with the charge air. In both cases, the lubrication points are serviced by filling the entire crankcase with oil droplets. Many of these are inevitably inducted into the cylinder. In a two-stroke engine including a lubrication system according to the present invention, oil is selectively distributed to surfaces where it is needed for lubrication, and oil droplets do not enter the charge air stream. Therefore, lubricating oil consumption is limited to small amounts spread on the cylinder walls and seeping through the piston ring gaps, as is typical of a four-stroke engine. The lubrication system of the invention greatly reduces the excessive oil combustion and unburned emission of conventional two-stroke engines (especially at idle speeds), which has reduced two-stroke acceptance on environmental grounds. The invention's lubrication system makes the task of premixing oil and fuel unnecessary and avoids the loss of lubricating potential attendant to dilution with fuel. Employment of the invention should lead to a reduction in lubricating oil consumption, thereby lowering the operating cost of such engines. The lubricating system also reduces spark plug fouling and combustion chamber carbon deposits, because very little lubricating oil is burned in the cylinder. The reduction in oil consumption in the cylinder inherent in dry-sump lubrication might make it feasible to equip the a two-stroke engine according to the present invention with a catalytic converter. Catalytic converters are not presently used on conventional two-stroke engines because they become fouled with oil emitted from the cylinder.

Optionally, the present invention may be combined with features, including: (1) separate scavenging and charging air flows; (2) a throttleable charging air flow; (3) a port opening sequence wherein the exhaust port opens, followed by the scavenging port opening, followed by a charging port opening; and (4) variable exhaust port timing; as disclosed in commonly owned U.S. Pat. No. 6,397,795, the entire disclosure of which is hereby incorporated herein by reference.

BRIEF DESCRIPTION OF THE DRAWINGS

FIGS. 15A–15E are simplified schematic drawings illustrating valve operation in the four-stroke engines of FIGS. 11–12 and 13–14.

DETAILED DESCRIPTION

By way of example only, FIGS. 1–5 illustrate an exemplary embodiment of the present invention, namely a single-cylinder, single main bearing, two-stroke, spark-ignited, over-square (bore to stroke ratio 2.38) engine of about 126 cubic centimeters gas displacement. However, the present invention has useful application in all other two-stroke and four-stroke, spark-ignition and compression-ignition engines. The invention provides a traveling annular oil chamber allowing for a dry-sump lubrication system for two- or four-stroke engines, which is particularly useful for hand-held power tools and aircraft engines.

Figure 1:
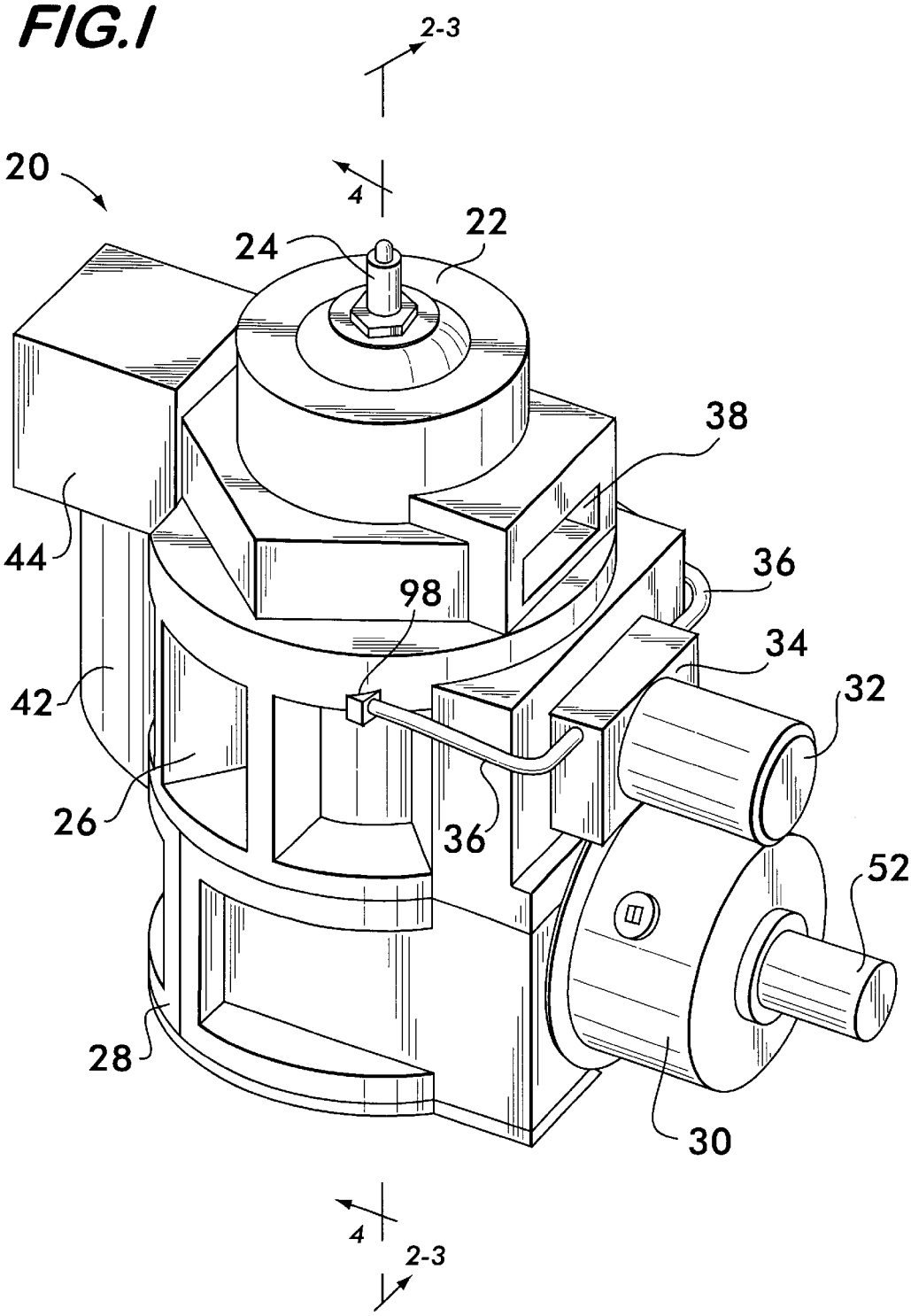
FIG. 1 is an external perspective view of an engine according to the invention.

Shown in FIG. 1 is an external view of an engine 20 according to the invention. As generally known in the art, engine 20 comprises a cylinder 22 in which a spark plug 24 is mounted. Also shown is an exhaust port 38 in cylinder 22, a charging tube 42 and a fuel metering device 44. While the fuel metering device 44 preferably uses a carburetor, it may also use an injector unit or a manifold fuel injection system to provide more precise control, though at greater expense. If it is found that the short duration of the fuel event does not allow for adequate atomization, then a modified carburetor design for providing adequate atomization may be employed. Alternatively, magnetic or electromagnetic-induced vibration of the fuel jet, the fuel stream itself, a screen in the fuel intake tube, etc., may be used to provide adequate fuel atomization. Charging tube 42 connects the crankcase to the fuel metering device 44 that supplies fuel to the cylinder 22 during engine operation. Optionally, the charging port is oriented so as to direct the charge towards the spark plug 24 to develop a stratified fuel air mixture within the cylinder with a relatively rich fuel-air mixture positioned in the immediate vicinity of the spark plug, as disclosed in U.S. Pat. No. 6,397,795. Additionally, the fuel/air charge may be mixed by swirling as it enters the combustion chamber or as it passes over contoured fins in the charging tube for swirling the charge.

Figure 2:
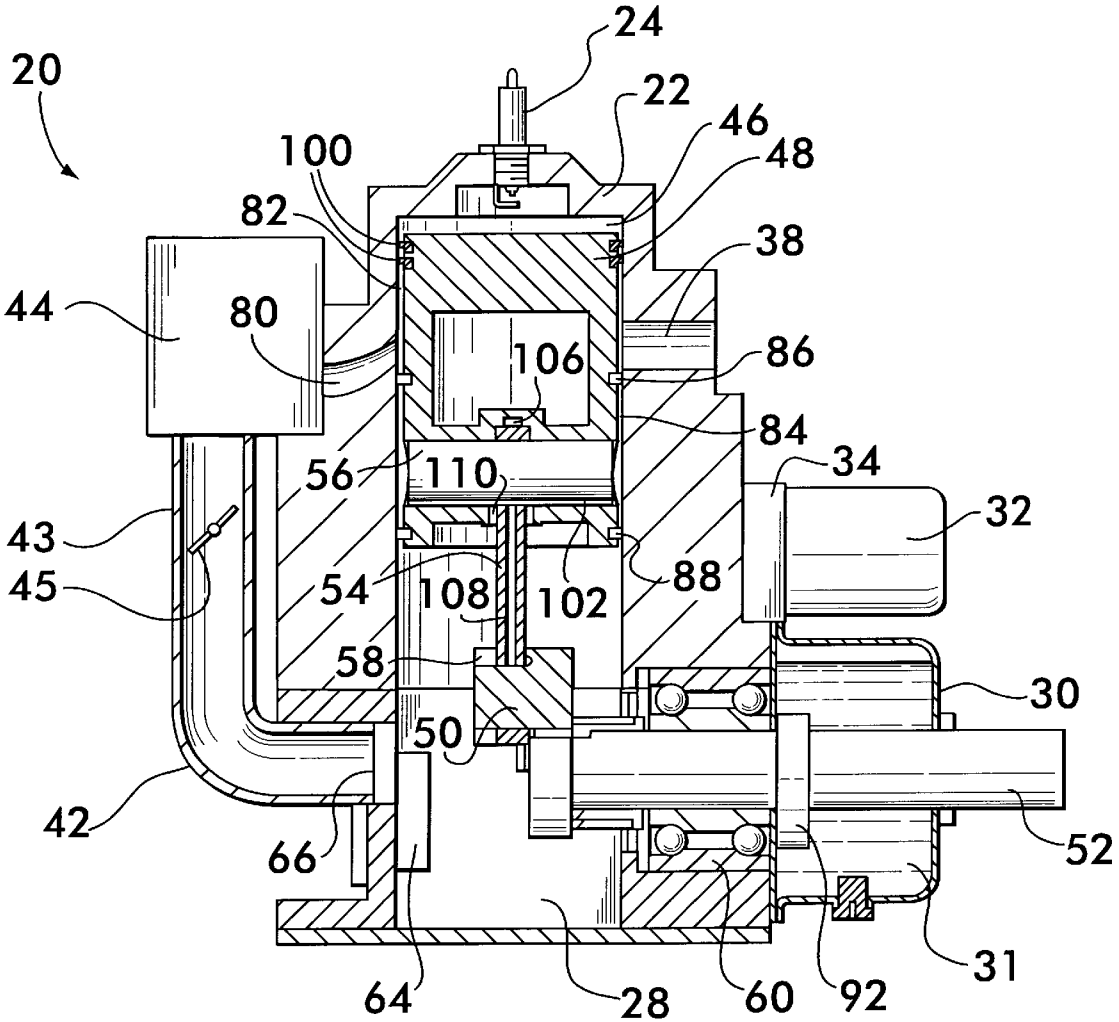
FIG. 2 is a sectional view taken along lines 2—2 of FIG. 1, showing the piston at the top of its stroke.
Figure 3:
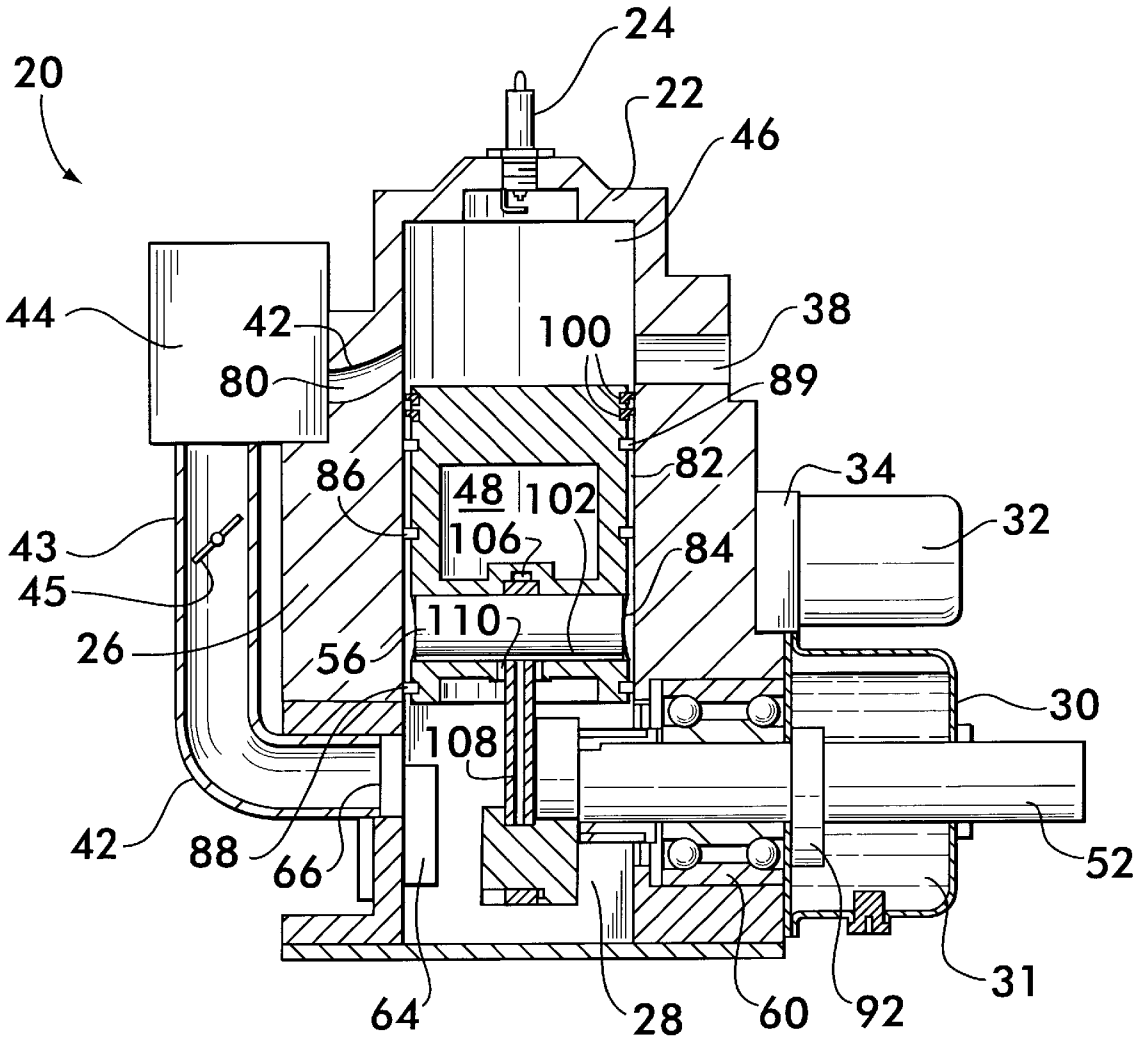
FIG. 3 is a sectional view taken along lines 3—3 of FIG. 1, showing the piston at the bottom of its stroke.

As shown in the sectional view of FIG. 2, and as generally known in the art, cylinder 22 has a bore 46 receiving a piston 48 capable of reciprocal motion within the cylinder bore 46. Cylinder bore 46 is sized to form an annular space 82 between the cylinder 22 and the piston 48. Piston 48 is connected to a throw 50 of a crankshaft 52 by a piston rod 54. Piston rod 54 is pivotally connected at one end to the piston 48 by means of a wrist pin 56, and at an opposite end to the throw 50 of the crankshaft 52 by a crankshaft bearing 58. Crankshaft 52 is mounted on main bearing 60 in crankcase 28. It is understood that all bearings may be provided with oil seals that prevent oil from leaking from the bearings. One-way valves 64 (only one being shown), preferably in the form of reed valves, are mounted in the crankcase 28 to allow ambient air to enter and replace the air that flows to the cylinder 22. The crankcase 28 has a further opening 66 that allows air from the crankcase 28 to flow into the charging tube 42 via the reed valve 64. As shown in FIG. 3, a charging (intake) port 80 in cylinder 22 is connected to the fuel metering device 44 to allow a fuel-air charge to enter the cylinder bore 46 during engine operation.

An oil reservoir 30 holds lubricating oil. Associated with the oil reservoir 30 are an oil filter 32, an oil distribution manifold 34 and oil lines 36 (see FIG. 1) connecting the manifold 34 with the cylinder 22. In the embodiments shown in FIGS. 1–5, the oil reservoir 30 is mounted on, but segregated from, the crankcase 28 and is in fluid communication with main bearing 60.

According to the present invention, seals 86 and 88 are provided on the piston 48 to define an annular oil chamber 84 as a portion of the annular space 82 between the cylinder 22, piston 48 and seals 86, 88. The seals 86, 88 keep the oil within the annular oil chamber 84. Annular oil chamber 84 provides lubricating oil to the piston 48, cylinder 22, and wrist pin 56. In a dry sump embodiment, as shown in FIGS. 1–5, oil circulated through the annular oil chamber 84 may travel through conduits to the crank bearing 58 and the main bearing 60 as described below.

The first seal 86 is mounted on and circumferentially around the piston 48 between the piston 48 and the cylinder 22 to define an upper end of the annular oil chamber 84. For example, the first seal 86 may be positioned in a groove extending around the piston 48, much like similar grooves used for conventional compression rings. The first seal 86 has an outer circumference engaging the cylinder 22 to limit any oil flowing from the annular oil chamber 84 to the cylinder bore 46.

As shown in FIGS. 1–5 and for other two-stroke engines, the first seal 86 is mounted on the piston 48 to be below the charging/intake and exhaust ports 80 and 38, respectively, when the piston 48 is at a top of its stroke (top-dead-center) within the cylinder bore 46, as best shown in FIG. 2. In such two-stroke engines, the first seal 86 is typically provided in addition to any conventional compression and/or oil control rings 100 so that the first seal 86 may be positioned below the intake and exhaust ports 80, 38 to prevent oil from escaping into the ports.

If desired, the first seal 86 may be constructed according to conventional oil ring practice to permit a controlled amount of oil to pass from the annular oil chamber 84 into an upper portion of the cylinder 22 to lubricate the cylinder 22, piston 48 and compression rings 100 as it traverses the cylinder 22, as is generally known in the art for conventional compression and/or oil control rings. For example, such oil may be held in scoring or cross-hatching of the cylinder 22, as is generally known in the art. Alternatively, the first seal 86 may be a sealing ring, substantially blocking oil flow thereby.

The second seal 88 is mounted on and circumferentially around the piston 48 between the piston 48 and the cylinder 22 and between the first seal 86 and the crankcase 28, to define a lower end of the annular oil chamber 84. The second seal 88 may be positioned in a groove of the piston as described above for the first seal 86.

The second seal 88 is mounted on the piston 48 to be in contact with the cylinder 22 when the piston 48 is at a bottom of its stroke (bottom-dead-center) within the cylinder bore 46 as best shown in FIG. 3. To maintain the annular oil chamber 84 over the entire length of the piston's stroke, the cylinder 22 may need to be extended toward the crankcase 28, relative to a conventional cylinder, to lengthen the cylinder wall. Alternatively, an oil sleeve may be provided between the cylinder and the crankcase to effectively lengthen the cylinder wall, as described in detail in U.S. Pat. No. 6,397,795. The oil sleeve has a bore therethrough coaxially aligned with the cylinder bore and sized to receive the piston. The piston is therefore reciprocable within the oil sleeve and cylinder bore and the annular oil chamber is defined between the piston and the oil sleeve and/or the cylinder. As referred to herein, the term "cylinder" refers to a cylinder and/or an oil sleeve.

The second oil seal 88 differs from a typical oil control ring in that it substantially prevents oil flow from the annular oil chamber 84 to the crankcase 28, thus, keeping the crankcase 28 free of lubricating oil and ensuring a dry sump, even with two-stroke engines. For this purpose, an oil control ring may be used such that the ends of the oil control ring are tapered, beveled and/or overlapped to substantially close the usual gap between piston ring ends. The second seal 88 prevents a substantial amount of oil from flowing into the crankcase 28.

The first and second seals 86, 88 therefore are fixed to and reciprocate with the piston 48, thus forming a traveling annular oil chamber 84 that lubricates the cylinder 22, piston 48, compression and/or oil control rings 100, and/or seals 86, 88.

The first and second seals 86 and 88 may be constructed of sintered bronze. Seals of other materials, such as graphite compounds or elastomerics such as rubber, are also suitable. Alternatively, such seals may be constructed of long-wearing, heat resistant polymers, such as Teflon, Kevlar, and Viton. The choice of seal material and design will largely depend upon the particular engine, its displacement, expected duty (light or heavy), cost, maintenance requirements and design life expectancy. For example, the rings may be constructed to have beveled, overlying ends so as to be self-sealing, as well known in the art. Optionally, the rings may be constructed as O-rings having generally square cross-sections and concave sides so as to enhance sealing action.

Optionally, a wick-like ring 89 (shown only in FIG. 3), e.g. a ring of relatively porous or absorbent material, such as sintered bronze, is provided adjacent the compression and/or oil control rings 100 to better pick up oil deposited on a lower portion of the cylinder and carry it to upper portions of the cylinder that are not reached by the annular oil chamber 84.

It should be noted that any seals added in accordance with the present invention need not increase friction between the cylinder and piston by a substantial amount. This is due to the materials that may be used for the seals, and the need for relatively little pressure of the seals against the cylinder, which results from the fact that most of the heat and pressure due to combustion in the combustion chamber will be borne by the conventional compression rings. Any seals added in accordance with the present invention need withstand primarily the relatively low forces associated with the oil pressure.

An oil pump 92, preferably positioned within the oil reservoir 30, is driven by rotation of the crankshaft 52, e.g. by gearing thereto as known in the art, to pressurize oil 31 from the oil reservoir 30 and circulate it through the annular oil chamber 84 to lubricate the cylinder 22, piston 48, compression and/or oil control rings 100, and/or seals 86, 88.

Preferably, the first seal 86 is mounted above the wrist pin 56 and the second seal 88 is mounted below the wrist pin 56, as shown in the embodiment of FIGS. 1–5. In such embodiments, at least a portion of any oil 31 in the annular oil chamber 84 also lubricates the wrist pin 56.

Figure 4:
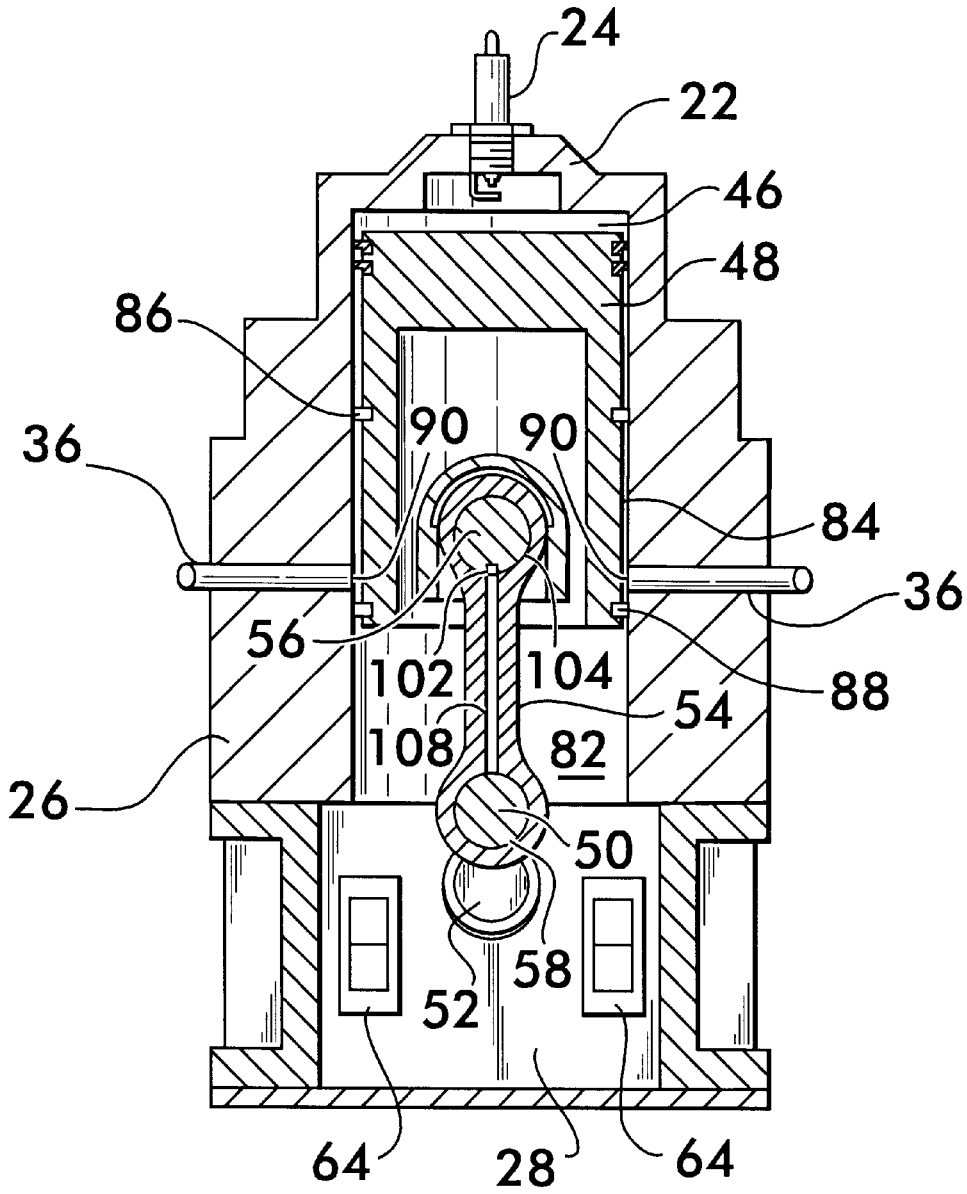
FIG. 4 is a sectional view taken along lines 4—4 of FIG. 1.

In the embodiment shown in FIGS. 1–5, lubricating oil 31 is supplied from the oil reservoir 30 and drawn through an oil duct (not shown) to the oil distribution manifold 34, which directs the oil 31 through an oil filter 32 and then to oil lines 36 (see FIG. 1) connecting the oil filter 32 to the cylinder 22. Oil lines 36 are in fluid communication with the annular oil chamber 84 though oil ports 90, as shown in FIG. 4.

In the exemplary two-stroke engine of FIGS. 1–5, the oil ports 90 are positioned in the cylinder 22 immediately below the position of the first seal 86 when the piston 48 is at the bottom of its stroke. In this location, oil ports 90 should never be passed by the second seal 88 throughout the entire range of motion of piston 48. This ensures that no oil will enter the crankcase 28 and contaminate the air therein and/or the intake and exhaust ports 80, 38.

An engine according to the present invention is operated to generate power in substantially the traditional manner, except for the lubrication system, as discussed further below.

As shown in FIGS. 2 and 3, oil supplied to the annular oil chamber 84 is contained between the piston 48 and cylinder 22 by the first seal 86 and second seal 88, both of which move with the piston 48.

As the piston 48 moves away from the spark plug 24 on the power stroke (for example, compare FIGS. 2 and 3), the first and second seals 86, 88 move with the piston 48 and cooperate with the piston 48 and cylinder 22 to define a traveling annular oil chamber 84 that is supplied by oil pump 92 with oil 31 drawn from the reservoir 30. In the embodiment of FIGS. 1–5, the oil is circulated through the oil distribution manifold 34, through the oil filter 32, through the oil lines 36, through the oil ports 90 and into the annular oil chamber 84. The traveling annular oil chamber 84 provides lubricating oil 31 to the surface of the cylinder 22 over which it passes, depositing oil thereon which is held in scoring and/or cross-hatching in the cylinder wall, as in known in the art. Oil held therein is carried to upper portions of the cylinder. More specifically, oil deposited on the cylinder 22 by the oil chamber 84 during an upstroke of the piston is picked up by the compression, oil control or compression rings 100 during a downstroke, which rings then carry the oil to upper portions of the cylinder during the next upstroke. Accordingly, the compression rings, etc. 100 can carry oil to portions of the cylinder 22 that are never reached by the oil chamber 84. This is particularly important in two-stroke engines to carry oil to portions of the cylinder 22 above the intake and exhaust ports.

Figure 5:
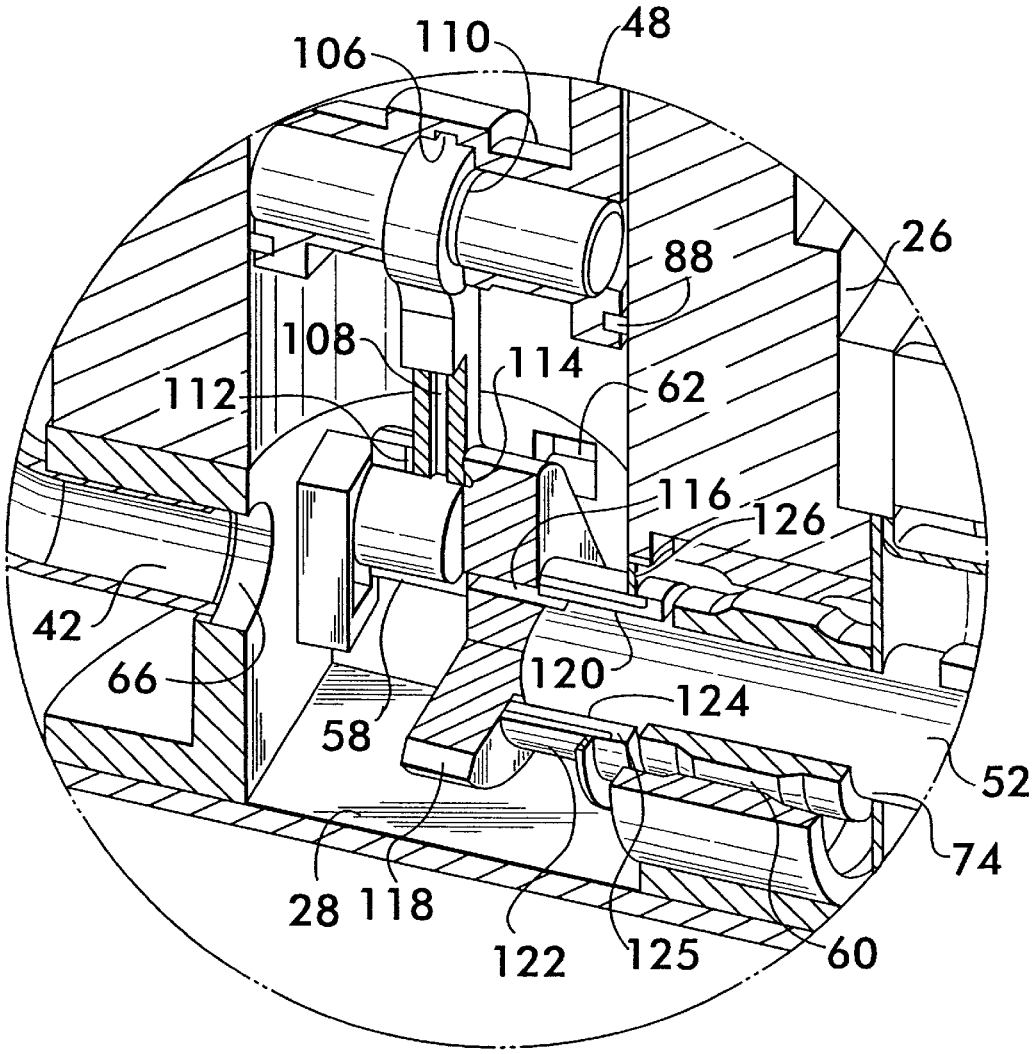
FIG. 5 is a partial cut-away view of the engine of FIG. 1.

In the exemplary engine shown in FIGS. 1–5 (as best shown in FIGS. 4 and 5), pressurized oil from the annular oil chamber 84 flows through port 90 into an oil groove 102 in the wrist pin 56 exposed to the annular oil chamber 84. This oil flow lubricates the wrist pin bearing 104 (see FIG. 4) connecting the piston rod 54 to the wrist pin 56. Oil from the groove 102 collects in a central groove 106 around the wrist pin 56. As shown in FIGS. 2 and 3, the central groove 106 communicates with a passage 108, extending along and through substantially the center of the piston rod 54. As best shown in FIGS. 3 and 5, a pair of piston rod seals 110 help contain the oil within the wrist pin bearing 104. Due to the piston rod seals 110, the first and second seals 86 and 88, as well as the position of second seal 88 between the wrist pin and the crankshaft, oil lubricating the wrist pin bearing 104 may only pass out of the annular oil chamber 84 via the passage in the piston rod 54. Oil does not seep into the crankcase 28.

Figure 5A:
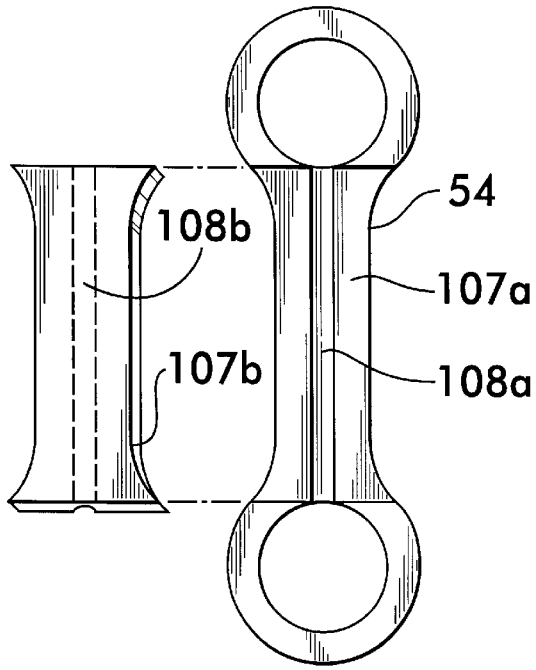
FIG. 5A is an exploded view of an exemplary embodiment of the piston rod of FIGS. 1–5.
Figure 5B:
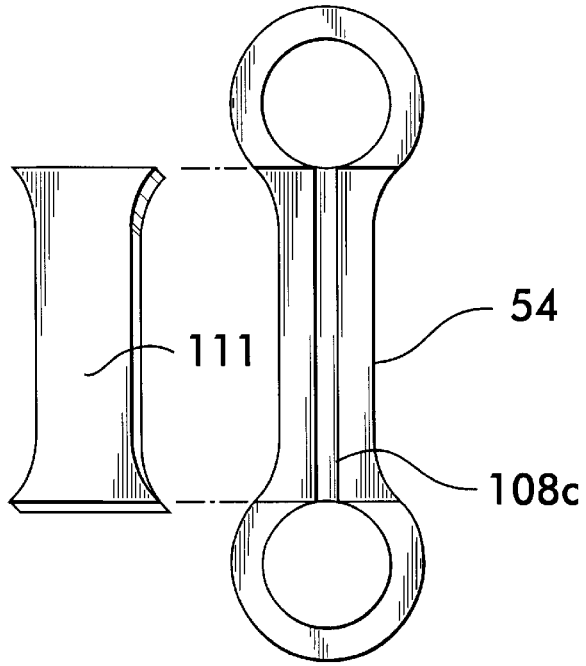
FIG. 5B is an exploded view of an alternative embodiment of the piston rod of FIG. 5A.

As illustrated in FIG. 5A, the piston rod 54 may be constructed of two mated portions 107*a* and 107*b* with facing grooves 108*a* and 108*b* to form the passage 108 on assembly. Alternatively, as shown in FIG. 5B, the piston rod 54 may be made from a single piece having a groove 108 with a light cover 111 fixed along its length to close the open side of such a groove to form the passage. The cover may be a piece of sheeting, such as sheet metal or foil plastic film, etc., tightly wrapped around the piston rod 54 to make the groove 108 an oil-tight conduit. Lubricating oil passes from the piston rod oil passage 108 to the piston rod crank bearing 58. Oil is contained within the crank bearing 58 by crank bearing oil seal 112 (see FIG. 5), so that oil does not seep into the crankcase 28.

In the embodiment shown in FIGS. 1–5, oil flushing out of the crank bearing 58 passes into a circumferential crank throw undercut 114, which communicates with a crankshaft oil passage 116 drilled through the crankshaft counterweight 118 (FIG. 5). The crankshaft oil passage 116 communicates with a crankshaft sleeve circumferential passage 120 cut around the inside of one end of the crankshaft sleeve 122. Oil passes along the crankshaft sleeve 122 through four crankshaft sleeve axial oil passages 124, and exits the crankshaft sleeve 122 through four crankshaft sleeve radial oil passages 125. The crankshaft sleeve radial oil passages 125 are separated from the crankcase 28 by the crankcase sleeve oil seal 126, so that oil does not seep into the crankcase 28.

For the exemplary embodiment shown in FIGS. 1–5, as best shown in FIG. 5, oil exiting the crankshaft sleeve radial oil passage(s) 125 passes through the main bearing 60, lubricating it, before returning to the oil reservoir 30. In this manner, the engine components described above provide a system of sealed passages or conduits leading to and from the annular oil chamber 84.

This completes one complete cycle of the lubricating oil around the engine according to exemplary embodiments of the invention shown in FIGS. 1–5.

Alternatively, oil may be circulated in an opposite direction.

Figure 6:
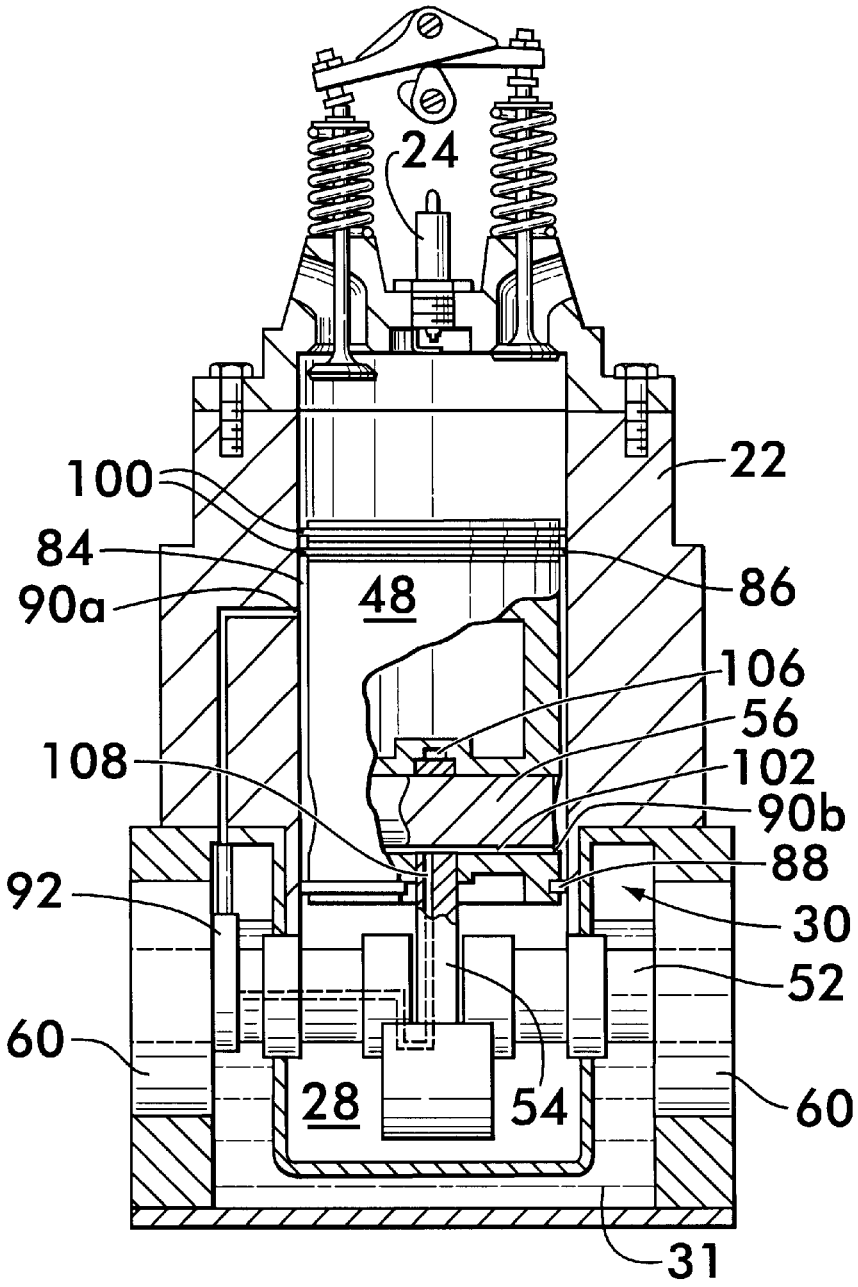
FIG. 6 is a partial cut-away view of a portion of an exemplary four-stroke engine according to an alternative embodiment of the present invention.

An exemplary four-stroke engine in accordance with the present invention is shown in FIG. 6. In four-stroke engines, such as that shown in FIG. 6, a single ring may act as both the first seal 86 and a compression and/or oil control ring 100, as discussed further below. In other words, a compression and/or oil control ring 100 may be used as the first seal 86, and only the lower, second seal 88 is added to provide the annular oil chamber 84 according to the present invention.

As discussed in detail above with reference to FIGS. 1–5, oil is supplied to the cylinder 22 via an oil port 90*a* positioned in the cylinder 22 immediately below the position of the first seal 86 when the piston 48 is at the bottom of its stroke. In this location, oil port 90*a* should never be passed by the second seal 88 throughout the entire range of motion of piston 48.

Similarly to the return oil conduit of FIGS. 1–5 (although shown in dashed line in FIG. 6 for simplification), the alternative engine embodiment of FIG. 6 includes an oil port

90*b* provided on wrist pin 56 in fluid communication with wrist pin groove 102, central groove 106, piston rod passage 108, crank throw undercut 114, crankshaft passage 116, crankshaft sleeve circumferential passage 120 and crankshaft sleeve axial and radial passages 124, 125. Because these passages are all in fluid communication with each other they may be considered to be a single conduit that allows oil to flow from the annular oil chamber 84 back to the oil reservoir 30 while lubricating the various engine components, generally as described above with reference to FIG. 5.

In contrast to the conduits discussed above with reference to FIG. 5, the return oil conduit of FIG. 6 does not provide oil to the main bearing 60. Rather, the main bearing 60 is positioned within or otherwise in direct fluid communication with the oil reservoir 30 and is lubricated by any oil therein. More specifically, oil exiting the crankshaft sleeve radial oil passage(s) returns to the oil reservoir 30, the main bearing 60 being positioned within or in fluid communication with the oil reservoir 30 and being lubricated by any oil 31 therein by direct contact and/or immersion therein. As in FIGS. 1–5, the oil reservoir 30 is segregated from the crankcase 28, so the crankcase 28 remains dry.

During operation, oil is carried by the annular oil chamber 84 for lubrication, as described above with reference to FIGS. 1–5. As shown in FIG. 6, oil travels around the annular oil chamber 84 and exits the annular oil chamber 84 through port 90*b* and along groove 102*b*, as generally described above.

Figure 7:
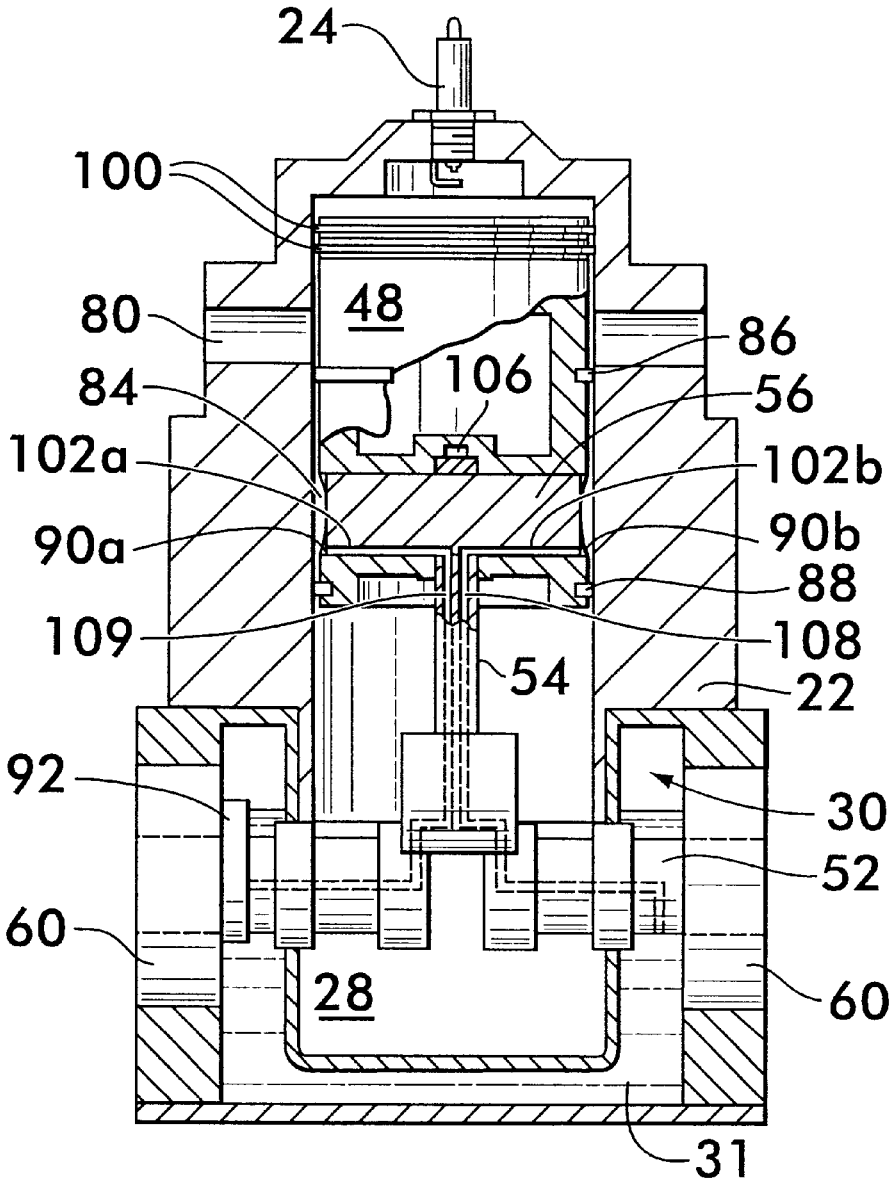
FIG. 7 is a partial cut-away view of a portion of an exemplary two-stroke engine according to another alternative embodiment of the present invention.
Figure 7A:
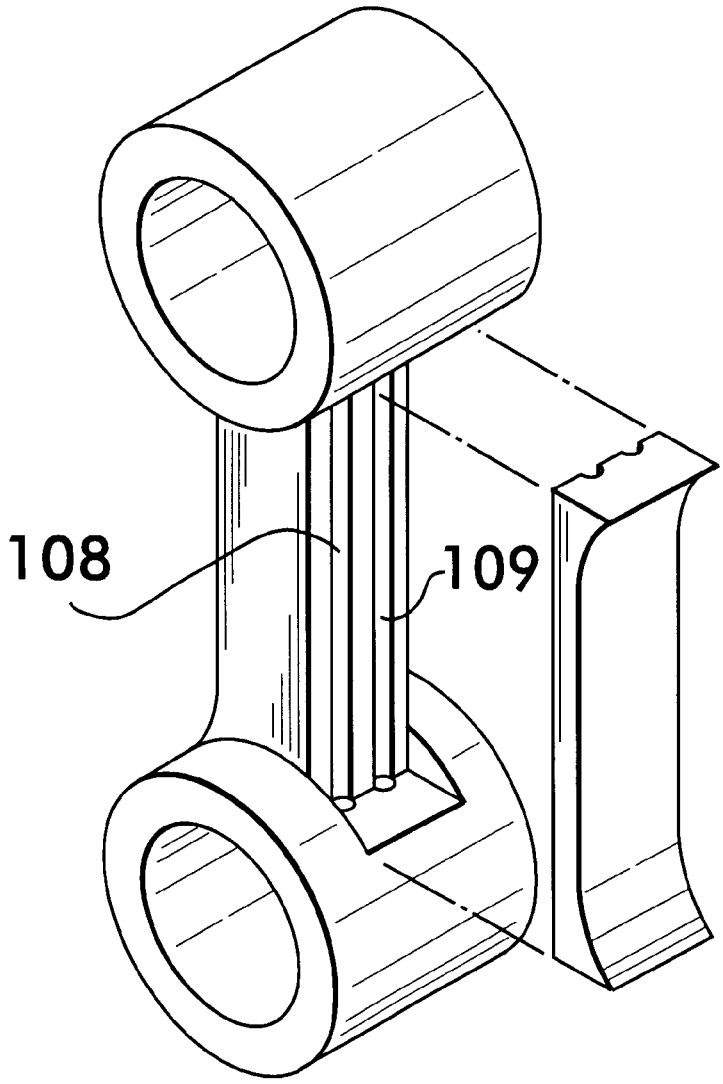
FIG. 7A is an exploded view of an exemplary embodiment of a piston rod usable with the engine of FIG. 7.

FIG. 7 shows an alternative embodiment of a two-stoke engine. As compared to the two-stroke embodiment shown in FIGS. 1–5, oil ports in the cylinder 22 are eliminated. Instead, the oil ports 90*a*, 90*b* are positioned in or through the piston 48, e.g. through the wrist pin 56. More specifically, the embodiment shown in FIG. 7 provides supply and return of oil via passages in the wrist pin 56, piston rod 54, crankshaft 52, etc. as discussed above with reference to FIG. 5. The piston rod 54 includes two separate passages 108, 109, as shown in FIG. 7A, and the conduit from the annular oil chamber 84 for returning oil to the oil reservoir 30 in FIGS. 1–6 is essentially duplicated to provide an additional conduit for supplying oil from the oil reservoir 30 to the annular oil chamber 84. The piston rod 54 may be constructed of two mating portions 107*a* and 107*b*, as shown in FIG. 7A, or from a single piece having a groove 108*c* with a light cover 111, similar to that shown in FIG. 5B.

In the exemplary two-stroke engine embodiment of FIG. 7, the seals 86, 88 are provided as discussed above with reference to FIGS. 1–5. The main bearing 60 is lubricated as discussed above with reference to FIG. 6. Lubricating oil 31 is supplied from the oil reservoir 30 and is pressurized by pump 92 and forced into the crankshaft sleeve through four crankshaft sleeve radial oil supply passages that are separated from the crankcase 28 by the crankcase sleeve oil supply seal, so that oil does not seep into the crankcase 28 (see corresponding structures in FIG. 5). As discussed with reference to FIG. 5, oil passes along the crankshaft sleeve through four crankshaft sleeve axial oil supply passages. Oil passes along the crankshaft sleeve circumferential supply passage cut around the inside of one end of the crankshaft sleeve. The crankshaft supply passage communicates with the crankshaft oil supply passage. The crankshaft oil supply passage is drilled through the crankshaft counterweight. Oil passes from the crankshaft oil supply passage to a circumferential crank throw undercut which passes oil to the crank bearing 58. Oil then passes from the crank bearing 58 along the supply piston rod oil passage 109, to a central groove 106 around the wrist pin 56 and to a groove 102*a* in the wrist pin 56, to lubricate the wrist pin bearing 104, and to flow through port 90*a* into the annular oil chamber 84.

Since the wrist pin groove 102*a*, central groove 106, piston rod passage 109, crank throw undercut, crankshaft oil supply passage, crankshaft sleeve circumferential supply passage and crankshaft sleeve, crankshaft sleeve axial oil supply passages, and crankshaft sleeve radial oil supply passages are all in fluid communication with each other they may be considered to be a single conduit or passage that allows oil to flow to the annular oil chamber 84 from the oil reservoir 30 while lubricating the various engine components. An oil filter may be positioned along either the supply or return conduits.

Oil is carried by the annular oil chamber 84 for lubrication, as described above. The oil travels around the annular oil chamber 84 and exits the annular oil chamber 84 through port 90*b* and along groove 102*b*, as generally described above with reference to FIGS. 1–5 and 6. As discussed above with reference to FIG. 6, oil exiting the crankshaft axial oil passage(s) 124 returns to the oil reservoir 30 through passage 108 in piston rod 54, the main bearing 60 being positioned within or in fluid communication with the oil reservoir 30 and being lubricated by any oil 31 therein by direct contact and/or immersion therein.

This completes one complete cycle of the lubricating oil around the engine according to the exemplary embodiment of FIG. 7.

Figure 8:
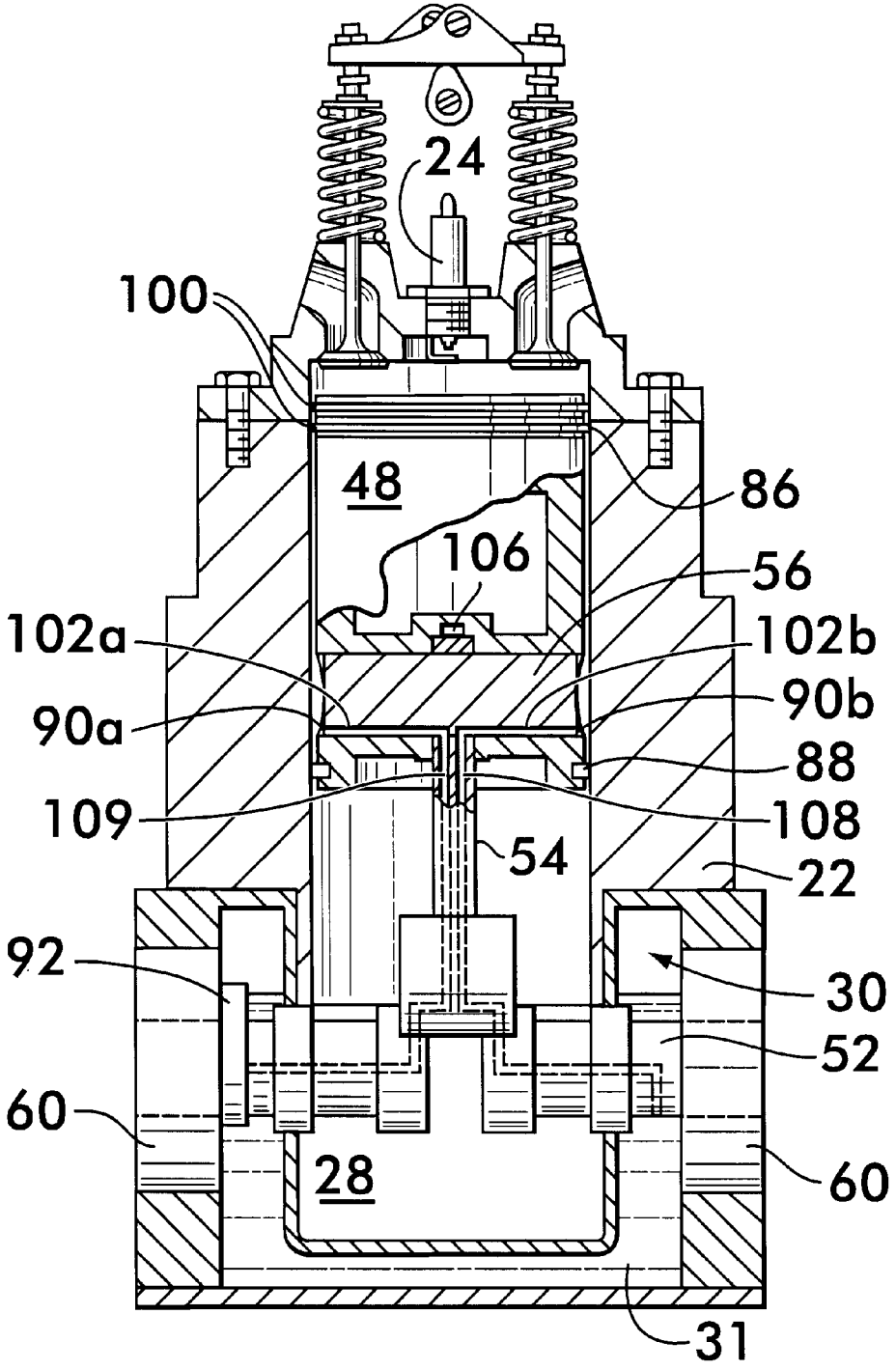
FIG. 8 is a partial cut-away view of a portion of an exemplary four-stroke engines according to yet another alternative embodiment of the present invention.

FIG. 8 shows an embodiment similar to that of FIG. 7, but adapted to a four-stoke engine. Accordingly, one of the compression rings 100 is used as the first seal 86, as discussed above with reference to FIG. 6. Operation of the engine and lubrication system occurs generally as described above with reference to FIGS. 6 and 7.

Because the embodiments of FIGS. 7 and 8 do not require oil ports in the cylinder wall, but rather the oil ports travel with the piston, a substantially shorter piston and cylinder may be used than that shown, as is presently commonplace.

Figure 9:
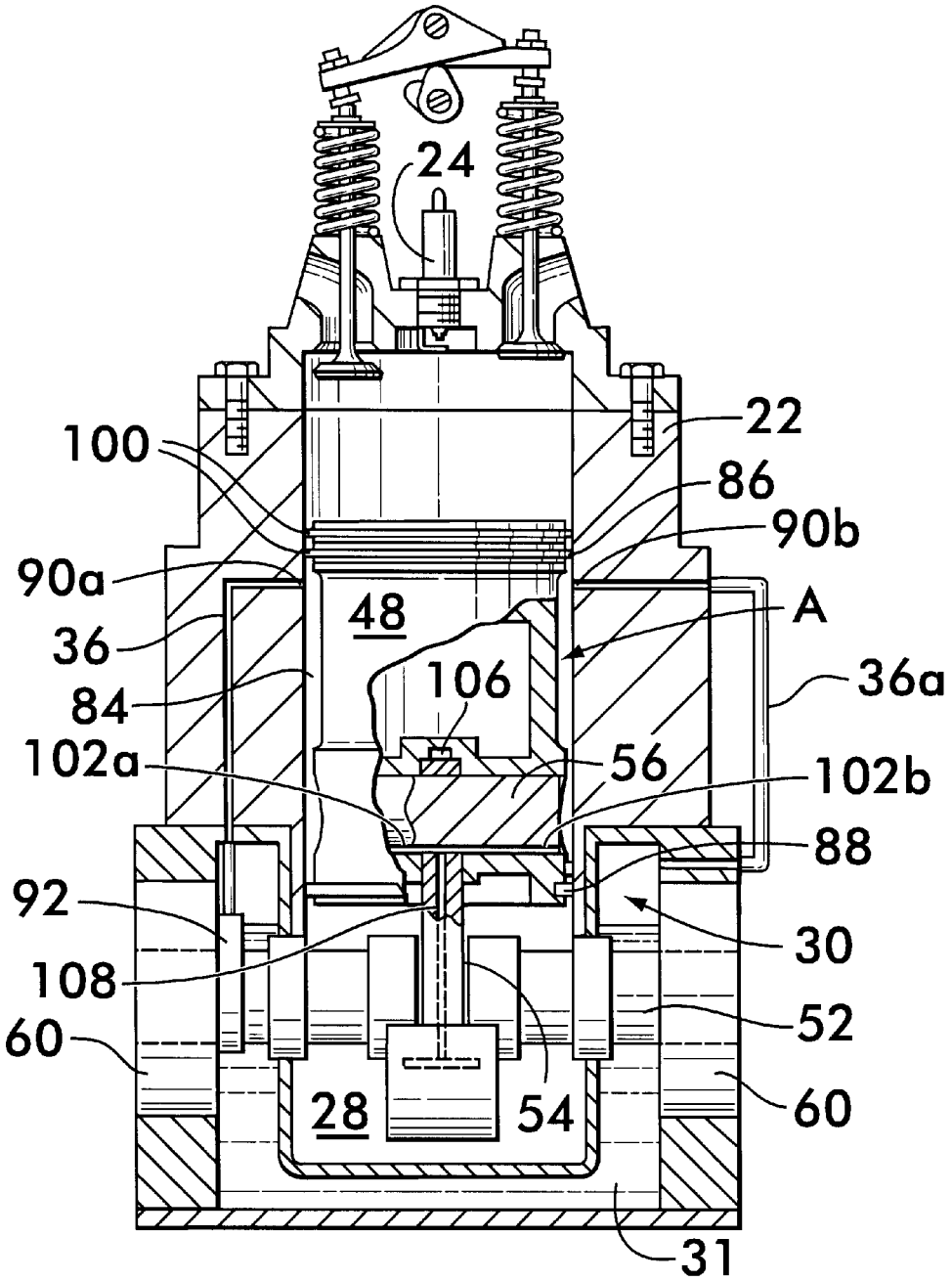
FIG. 9 is a partial cut-away view of a portion of an exemplary four-stroke engines according to yet another alternative embodiment of the present invention.

An alternative embodiment of a four-stroke engine is shown in FIG. 9. As shown in FIG. 9, oil is supplied to the annular oil chamber 84 as described above with reference to the embodiments of FIGS. 1–5 and 6. Additionally, an oil return port 90*b* is provided in the cylinder 22. The oil return port 90*b* is in fluid communication with annular oil chamber 84 and oil return line 36*a*. Like oil port 90*a*, oil return port 90*b* in the cylinder 22 is positioned in the cylinder 22 so as to always be between the first and second seals 86, 88 regardless of the position of piston 48. This ensures that no oil will enter the crankcase 28 and contaminate the air therein and/or the intake and exhaust ports. Oil return line 36*a* returns oil to the oil reservoir 30.

In the embodiment shown in FIG. 9, a piston rod 54 as shown in FIG. 5A may be used. Accordingly, a conduit is provided that extends through the wrist pin 56 to a central groove (port) 106 in fluid communication with the annular oil chamber 84 via grooves 102*a* and 102*b* to the piston rod 54 and along the piston rod 54 to the crank bearing along piston rod passage 108, as described above with reference to FIGS. 1–5 or 6–8. However, the oil that lubricates the crank bearing does not flow from it back to the oil reservoir 30. Rather, oil reaching the crank bearing is trapped by seals and does not travel along the crankshaft as described above with reference to FIGS. 1–5 or 6–8. Instead, the reciprocating motion of the piston 48 and the piston rod 54 will continually move oil throughout the various passages and grooves in the wrist pin 56 and piston rod 54. This action avoids stagnation of the oil and carbonizing. If desired, oil can be flooded into and out of the piston through several openings in the piston body. Optionally, a peltate may be provided in the passage of the piston rod 54, etc. to enhance oil movement. Moving air in the crankcase helps cool the wrist pin, piston rod and crank bearings, as known in the art. Cooling may be enhanced by providing cooling fins to help dissipate heat.

Optionally, in any of the embodiments discussed above, the cross-sectional area of the piston is reduced, as shown generally at A in FIG. 9, along at least a portion of the length of the piston between the upper and lower seals 86, 88. For example, the piston may have a reduced diameter. The cross-sectional area of the piston is reduced such that it enlarges the volume of the oil chamber 84 and therefore may provide an enhanced lubricating and/or cooling effect.

In some embodiments (not shown), the oil pump may be replaced or supplemented by one or more one-way or check valves provided along the oil passages, e.g. along the piston rod. In such embodiments, the inertia of the piston, crank and/or connecting rod is relied upon to move oil along the passages, the valves preventing simple reciprocation and enabling circulation of the oil.

If desired, a scavenging oil pump is provided to drain any minimal amounts of oil that may leak past the piston's lower seal into the crankcase. Alternatively, the bottom of the crankcase is provided with a port and one-way valve to permit such minimal amounts of oil in the crankcase to be expelled to the reservoir under pressure during the piston's downstroke, and to prevent suction of oil from the reservoir into the crankcase during the piston's upstroke.

It should be noted that in all embodiments of FIGS. 1–9 there is no oil in any charging flow passing through the crankcase 28 because the engine according to the invention uses the dry-sump lubrication system described above. Thus, the lubrication system of the invention, unlike conventional engines (especially two-strokes) is a dry-sump system wherein the crankcase is substantially free of oil and therefore allows engine operation without the wasteful and polluting combustion of lubricating oil entering the cylinder from the crankcase. Emission of unburned hydrocarbons is thereby reduced.

For two- and four-stroke engines, the lubrication system according to the invention provides an oil-free crankcase which allows the engine to be operated in any position, attitude or orientation and is advantageous for hand-held tools, aircraft, etc.

An engine according to the invention using a dry-sump lubrication system promises to provide engines (particularly two-stroke) having relatively low unburned hydrocarbon emissions, reduced lubricating oil combustion, and greater fuel and oil economy than conventional two-stroke engines currently in use. Additionally, the present invention may be combined with features including: (1) separate scavenging and charging air flows; (2) a throttleable charging air flow; (3) a port opening sequence wherein the exhaust port opens, followed by the scavenging port opening, followed by a charging port opening; and (4) variable exhaust port timing, as disclosed in U.S. Pat. No. 6,397,795.

Improved Scavenging in Two-Stroke Engines

Figure 10:
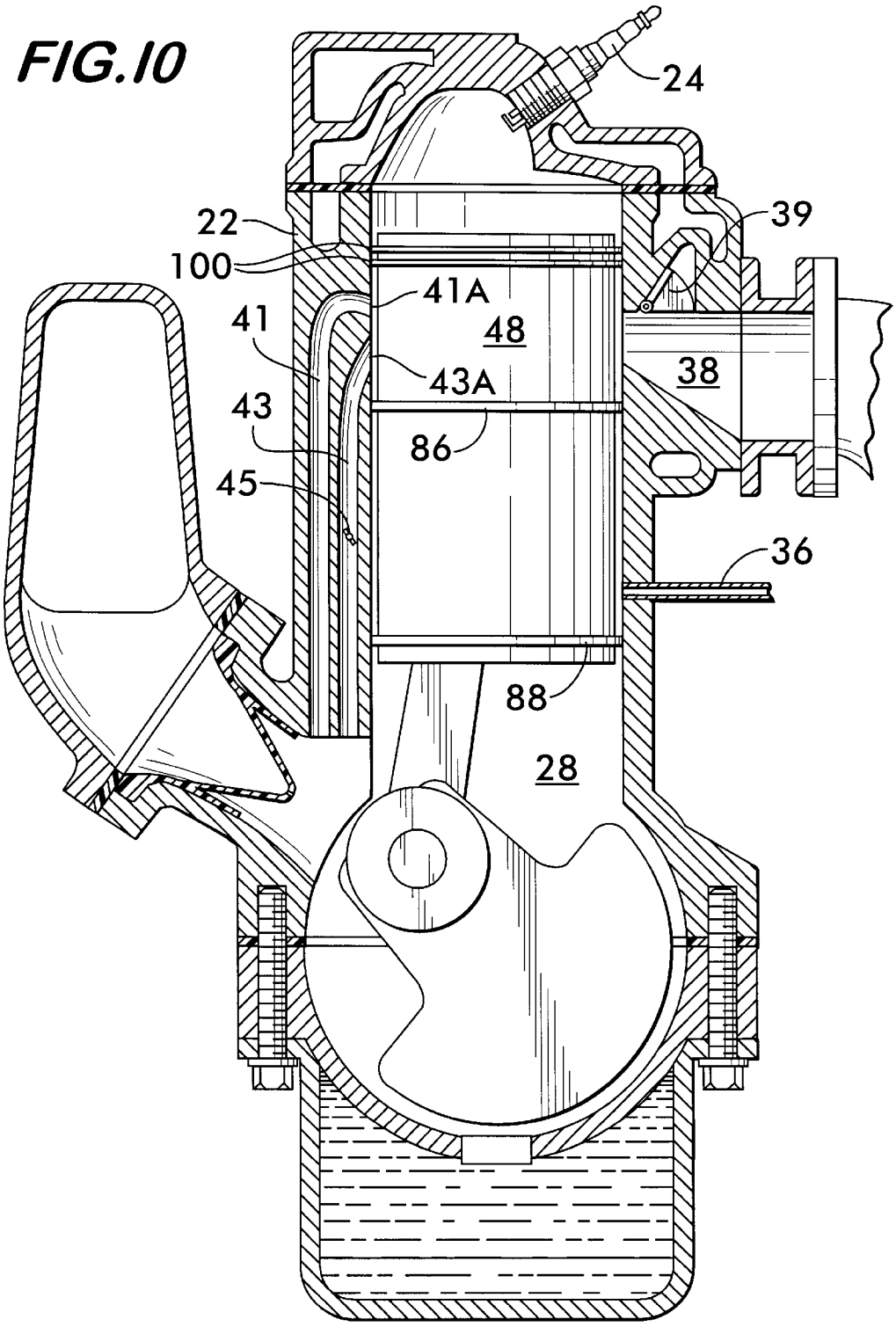
FIG. 10 is a sectional view of an exemplary two-stroke engine according to yet another alternative embodiment of the present invention, showing separated scavenging and charging air flows.
Figure 11:
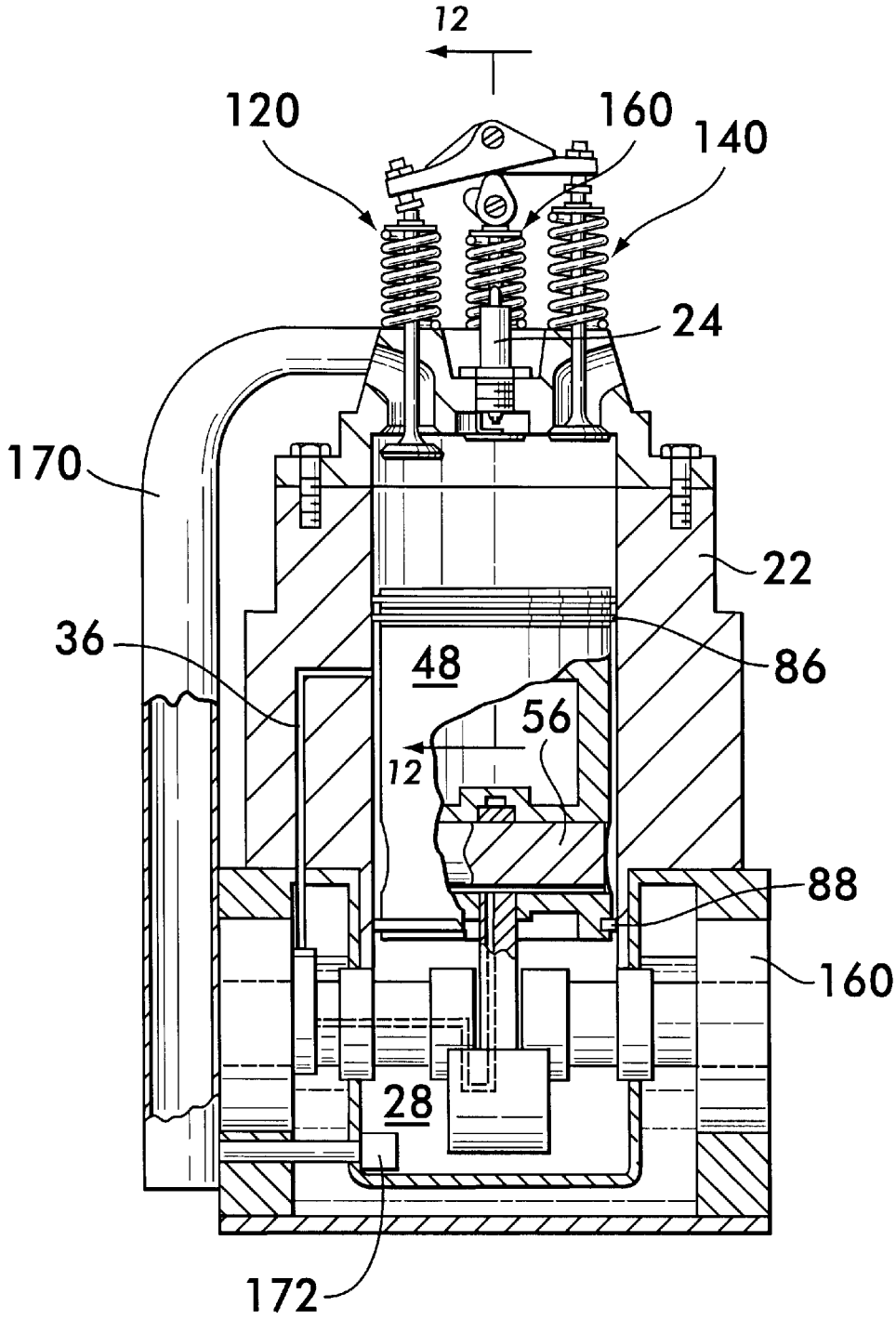
FIG. 11 is a sectional view of an exemplary four-stroke engine according to yet another alternative embodiment of the present invention, showing a transfer tube for inexpensive supercharging.
Figure 12:
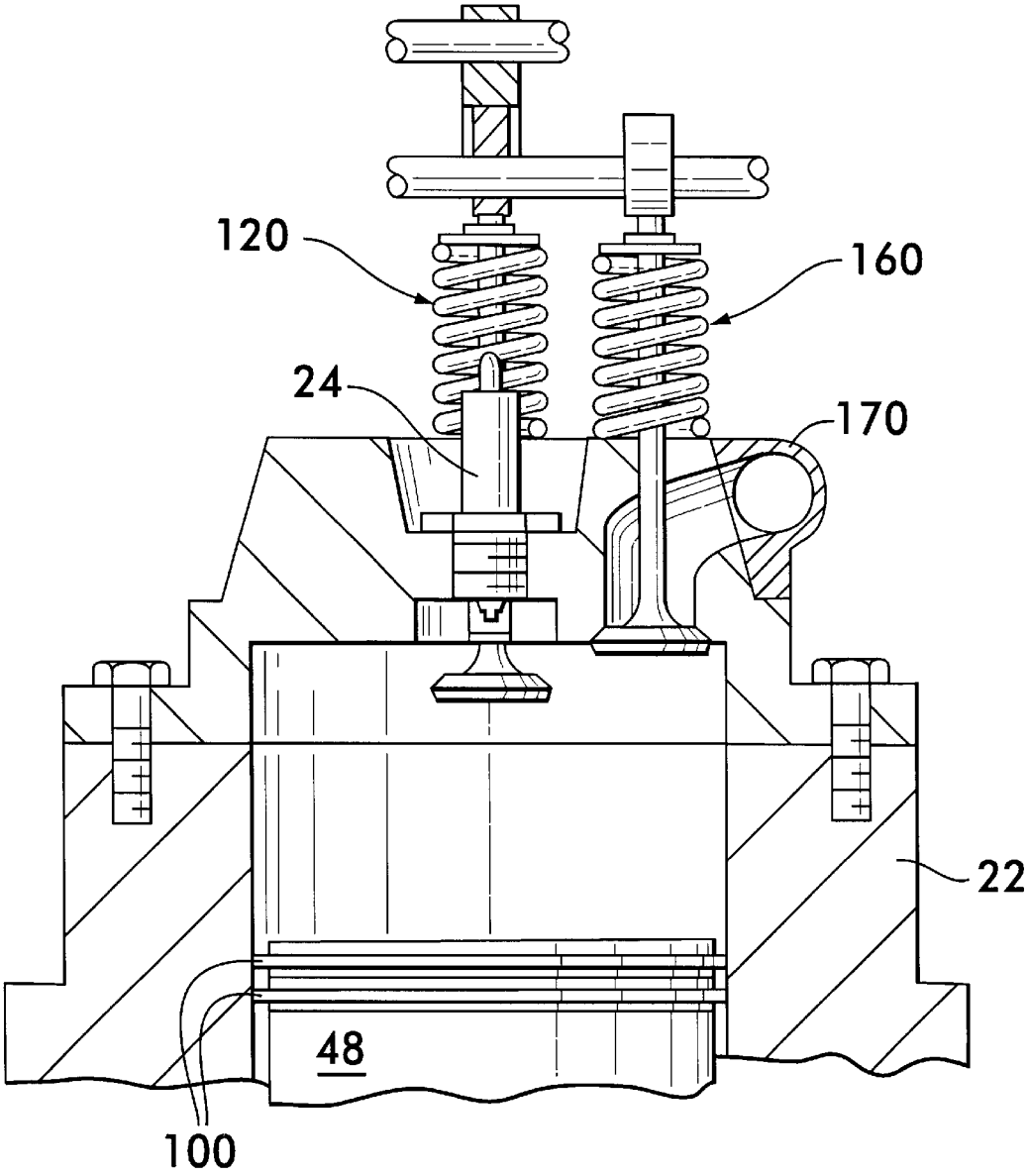
FIG. 12 is a partial sectional view of the four-stroke engine of FIG. 11.

Optionally, with reference to FIG. 10, the present invention may be incorporated into an engine having separate scavenging 41 and charging 43 tubes to separate the scavenging and charging air streams and result in a reduction of unburned hydrocarbons in two-stroke engines, as disclosed in U.S. Pat. No. 6,397,795. In such an embodiment, at about 120° of crank angle (60° before bottom dead center), a scavenging port 41A in the cylinder 22 is uncovered to allow air from the crankcase to flow through the scavenging tube 41 and the scavenging port 41A as it is displaced out of the crankcase 28 by the descending piston 48. In such an embodiment, unburned hydrocarbon emission is greatly inhibited (trapping efficiency is higher) because: (1) scavenging of exhaust gas is accomplished by a separated flow of air from the crankcase 28 which has no fuel or oil in it; (2) the scavenging flow precedes the charging (air/fuel) flow into the cylinder 22; and (3) mixing between the charge and the exhaust gas in the cylinder 22 is inhibited because this must take place through the intermediary of the scavenging air, and before any substantial mixing has time to occur, most of the exhaust gas will have been displaced out of the cylinder 22.

In an embodiment in which the intake flow is divided into separate charging and scavenging flows, and at partial-load, only the charging flow need be throttled, leaving the scavenging flow without pressure drop, and reducing the total amount of pumping power needed at partial-load, and thus increasing the engine's efficiency and allowing high efficiencies.

Preferably, the scavenging air flow tube 41 is directed toward the exhaust port 38 and is opened sooner on the piston downstroke to purge the cylinder of exhaust gases, etc. using an air flow that is free of fuel. Later on the downstroke, the port 43A to the charging tube 43 is opened to admit the fuel/air charge. Preferably the charging flow is directed toward the spark plug 24 to provide for stratified fuel charging. This results in a reduction of pollution and oil/fuel consumption.

Figure 13:
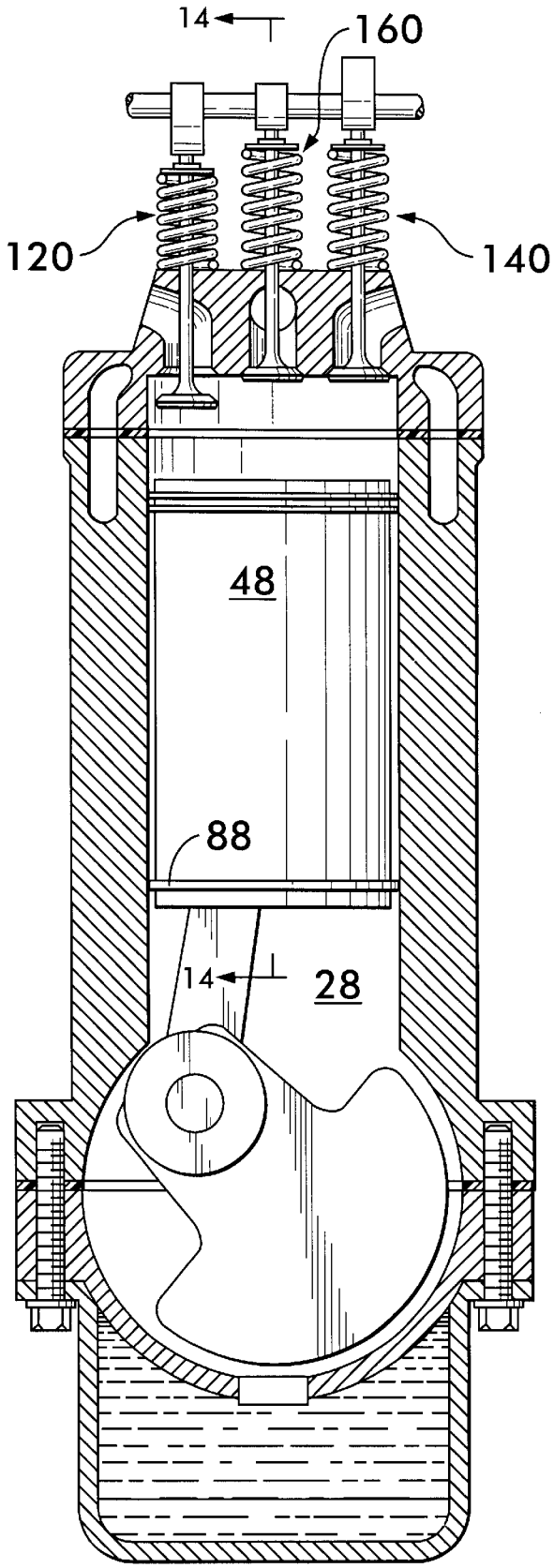
FIG. 13 is a sectional view of an exemplary four-stroke engine according to yet another alternative embodiment of the present invention.
Figure 14:
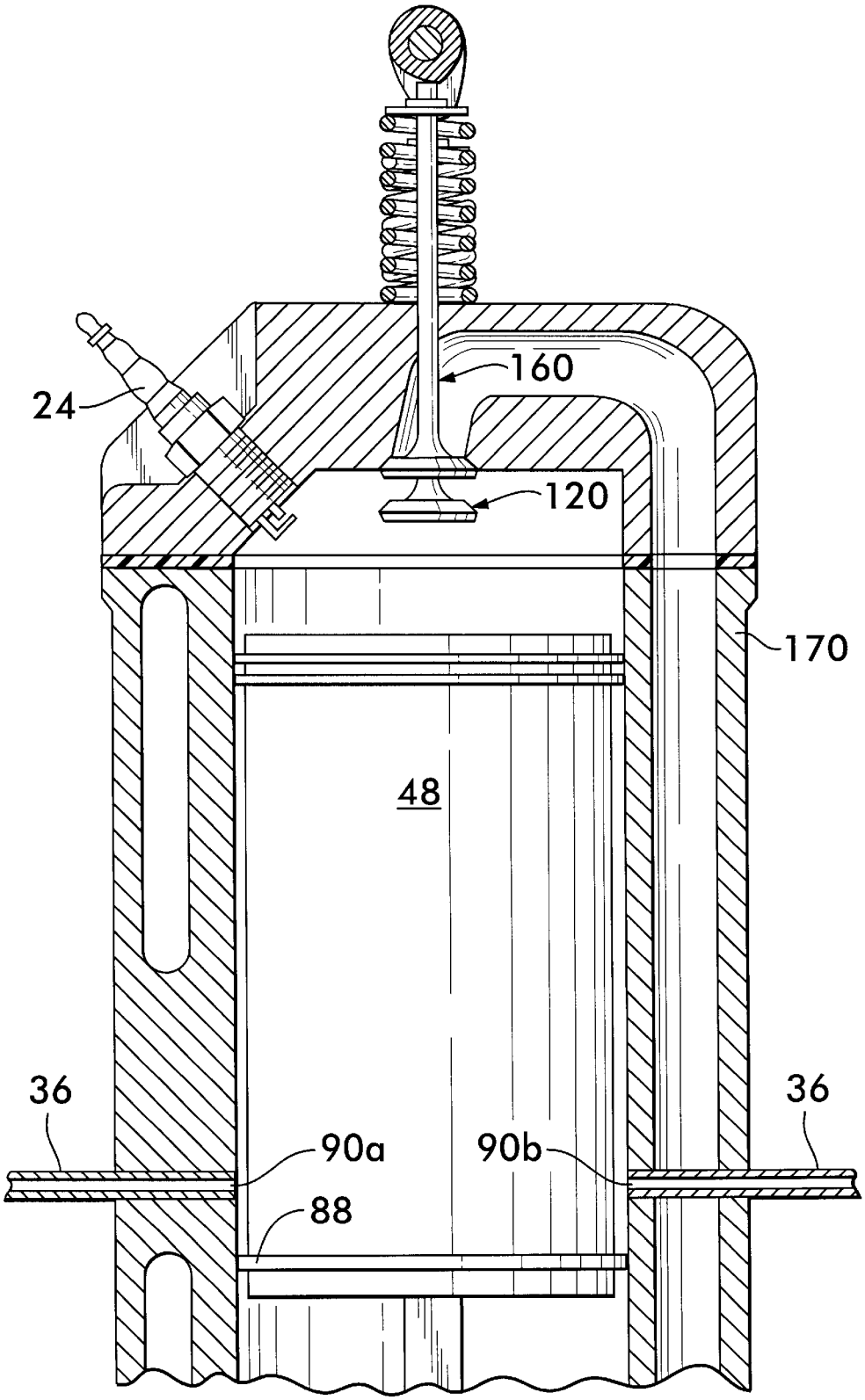
FIG. 14 is a partial sectional view of the four-stroke engine of FIG. 13.

FIG. 10 also shows a small opening or port, optionally fitted with a one-way valve as shown, toward the bottom of the crankcase 28 for draining any minimal amounts of oil that might leak into the crankcase. Drained oil is returned to the reservoir 30, without the need for a scavenging pump, through the valve under pressure during a downstroke of the piston 48. The one-way nature of the valve prevents suction of oil from the reservoir 30 into the crankcase 28 during the piston's upstroke. Similar structure is shown by way of example in FIG. 13 but may be incorporated into any embodiment shown.

Supercharging in Four-Stroke Engines

In certain embodiments, the present invention is combined with the teachings of U.S. Pat. No. 3,973,532 to Litz and/or U.S. Pat. No. 6,397,795, to provide a supercharging effect. More specifically, in four-stroke engines, considerably more crankcase charging volume and pressure can be achieved. Air enters the crankcase through a one-way valve and is compressed as disclosed in U.S. Pat. No. 3,973,532 to Litz (see FIGS. 11–15). The compressed air is forced, e.g. during the intake and power strokes, through a one-way valve 172 into a holding chamber/intake manifold or transfer tube 170 to the intake valve to the combustion chamber. This arrangement is disclosed in greater detail in U.S. Pat. No. 6,397,795.

In one embodiment, an additional pressure-operated valve (not shown) is added in the cylinder head that opens automatically to admit ambient air into the cylinder, filling it during the intake stroke. The conventional cam-operated combustion chamber intake valve is configured to stay closed until just before the intake stroke is completed, at which time it opens to top off the ambient air already in the cylinder with pressurized air from the holding chamber.

Alternatively, as shown in FIGS. 11–15, instead of the additional pressure-operated valve, an additional cam-operated intake valve 160 is provided in addition to the conventional intake and exhaust valves 120, 140, respectively. The conventional intake valve 120 opens when the intake stroke begins and closes when the additional intake valve 160 opens (at or very near the bottom of the intake stroke) to add pressurized air to the cylinder 22 from the holding chamber 170, as shown in FIGS. 15A and 15B. The positions of the valves during the compression, power and exhaust strokes are shown in FIGS. 15C–15E.

Variable Exhaust Valve Timing in Two-Stroke Engines

To take advantage of the functional relation between the timing of exhaust valve operation and engine speed to improve engine performance and efficiency, variable exhaust valve timing may be employed. For example, the present invention may be incorporated in an engine having variable exhaust valve timing effected through use of a movable exhaust port valve, such as pivoting gate valve 39 (FIG. 10) or eccentric tapered or conical spool valve. The spool valve may be used for achieving a reliable seal and to provide for easy assembly and maintenance. The gate valve 39 increases or decreases the height of the exhaust port 38 to vary the timing of the exhaust port's opening and closing. Such variable exhaust valve timing is disclosed in U.S. Pat. No. 6,397,795. For example, manipulation of the exhaust valve may be used to reduce escape via the exhaust port of the incoming air/fuel charge, to adjust the exhaust pulse, to tune for various engine speeds, or to vary compression to achieve dieseling or auto-ignition, if desired, as generally discussed in articles titled, *Quick Take: Honda EXP*-2, [online] [Retrieved on Sep. 30, 2002 ] Retrieved from the Internet using <URL http://www.motorcycle.com/momchonda/exp2.html and *Honda EXP*-2, [online] [Retrieved on Sep. 30, 2002 ] Retrieved from the Internet using <URL http://www.motorycle.com/mo/mchonda/exp_tech.html, the entire disclosure of both of which are hereby incorporated herein by reference.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. An internal combustion engine comprising:

a cylinder having a bore;

a piston reciprocable within said bore;

a crankcase;

a crankshaft rotatably mounted on a main bearing within said crankcase, said crankshaft having a throw;

a piston rod having a first end connected to said piston by a wrist pin, and a second end connected to said throw by a crank bearing;

an oil reservoir in fluid communication with said cylinder;

a first seal mounted on and circumferentially around said piston, said first seal moveably engaging said cylinder to limit oil flow thereby; and a second seal mounted on and circumferentially around said piston, said second seal being positioned between said first seal and said crankcase, said second seal moveably engaging said cylinder to substantially prevent any oil flow thereby into said crankcase;

said first and second seals cooperating with said piston and said cylinder to define an annular oil chamber moveable with said piston for lubricating said cylinder, said oil reservoir being in fluid communication with said cylinder to supply oil to, and receive returning oil from, said annular oil chamber.

2. An internal combustion engine according to claim 1, further comprising:

a first conduit extending between said oil reservoir and a first port of said cylinder in fluid communication with said annular oil chamber for receiving pressurized oil from said oil reservoir, said first port being positioned so as to always be between said first and second seals regardless of the position of said piston within said bore; and a second conduit for returning oil from said annular oil chamber to said oil reservoir, said second conduit extending between a second port of said cylinder in fluid communication with said annular oil chamber and said oil reservoir, said second port being positioned so as to always be between said first and second seals regardless of the position of said piston within said bore.

3. An internal combustion engine according to claim 2, wherein said first seal is mounted on said piston above said wrist pin, and wherein said second seal is mounted on said piston below said wrist pin, whereby at least a portion of any pressurized oil flowing into said annular oil chamber lubricates said wrist pin.

4. An internal combustion engine according to claim 2, further comprising:

a third conduit extending through a third port in fluid communication with said annular oil chamber to said piston rod and along said piston rod to said crank bearing.

5. An internal combustion engine according to claim 4, wherein said piston rod comprises a check valve positioned along said third conduit to prevent reciprocation of, and promote circulation of, oil along said third conduit as said piston rod is reciprocated.

6. An internal combustion engine according to claim 1, further comprising:

a first conduit extending between said oil reservoir and a first port of said cylinder in fluid communication with said annular oil chamber for receiving pressurized oil from said oil reservoir, said first port being positioned so as to always be between said first and second seals regardless of the position of said piston within said cylinder bore; and a second conduit for returning oil from said annular oil chamber to said oil reservoir, said second conduit extending through said piston from a second port in fluid communication with said annular oil chamber to said piston rod and along said piston rod to said crank bearing and from said crank bearing along said crankshaft to said main bearing and to said oil reservoir.

7. An internal combustion engine according to claim 1, further comprising:

a first conduit extending between said oil reservoir and a first port of said cylinder in fluid communication with said annular oil chamber for receiving pressurized oil from said oil reservoir, said first port being positioned so as to always be between said first and second seals regardless of the position of said piston within said cylinder bore; and a second conduit for returning oil from said annular oil chamber to said oil reservoir, said second conduit extending through said piston from a second port in fluid communication with said annular oil chamber to said piston rod and along said piston rod to said crank bearing and from said crank bearing along said crankshaft to said oil reservoir.

8. An internal combustion engine according to claim 1, further comprising:

a first conduit extending between said oil reservoir and a first port of said cylinder in fluid communication with said annular oil chamber for receiving pressurized oil from said oil reservoir, said first port being positioned so as to always be between said first and second seals regardless of the position of said piston within said cylinder bore and said oil sleeve bore; and a second conduit for returning oil from said annular oil chamber to said oil reservoir, said second conduit extending through said piston from a second port in fluid communication with said annular oil chamber to said piston rod and along said piston rod to said crank bearing and from said crank bearing along said crankshaft to said oil reservoir.

9. An internal combustion engine according to claim 1, further comprising:

a first conduit extending between said oil reservoir and a first port of said cylinder in fluid communication with said annular oil chamber for receiving pressurized oil from said oil reservoir, said first port being positioned so as to always be between said first and second seals regardless of the position of said piston within said cylinder bore; and a second conduit for returning oil from said annular oil chamber to said oil reservoir, said second conduit extending through said piston from a second port in fluid communication with said annular oil chamber to said piston rod and along said piston rod to said crank bearing and from said crank bearing along said crankshaft to said main bearing and to said oil reservoir.

10. An internal combustion engine according to claim 1, further comprising:

a first conduit extending from said oil reservoir through said crank to said crankshaft bearing, from said crank bearing along said piston rod to said wrist pin, and from said wrist pin to a first port in fluid communication with said annular oil chamber for receiving pressurized oil from said oil reservoir; and a second conduit for returning oil from said annular oil chamber to said oil reservoir, said second conduit extending from a second port in fluid communication with said annular oil chamber along said piston rod to said crank bearing along said crankshaft and from said crank bearing along said crankshaft to said oil reservoir.

11. An internal combustion engine according to claim 10, wherein said first and second conduits further extend along said crankshaft to said main bearing, and wherein at least a portion of any oil flowing through said crankshaft lubricates said main bearing.

12. An internal combustion engine according to claim 10, wherein said main bearing is positioned within said oil reservoir and is lubricated by any oil therein.

13. An internal combustion engine according to claim 10, wherein a portion of each of said first and second conduits comprises a groove arranged lengthwise along said wrist pin.

14. An internal combustion engine according to claim 10, wherein a portion of each of said first and second conduits comprises a passageway extending lengthwise through said piston rod from said wrist pin to said crank bearing.

15. An internal combustion engine according to claim 14, wherein said piston rod is formed of two elongated portions joined together along facing surfaces, at least one of said portions having a groove arranged lengthwise therealong, thereby forming said portions of said first and second conduits.

16. An internal combustion engine according to claim 14, wherein said piston rod has grooves arranged substantially along its length and a cover positioned over said groove thereby forming said portions of said first and second conduits.

17. An internal combustion engine according to claim 1, wherein said first and second seals each comprise a ring of sintered bronze.

18. An internal combustion engine according to claim 1, wherein said first and second seals each comprise a ring of a polymeric substance.

19. An internal combustion engine according to claim 1, wherein said oil reservoir is segregated from said crankcase.

20. An internal combustion engine according to claim 1, wherein said piston defines a reduced cross-section between said upper and lower seals.

21. A two-stroke internal combustion engine comprising:

a cylinder having a bore in communication with intake and exhaust ports;

a piston reciprocal within said bore;

a compression ring mounted on and circumferentially around said piston;

a crankcase;

a crankshaft rotatably mounted on a main bearing within said crankcase, said crankshaft having a throw;

a piston rod having a first end connected to said piston by a wrist pin, and a second end connected to said throw by a crank bearing;

an oil reservoir in fluid communication with said cylinder;

a first seal mounted on and circumferentially around said piston above said wrist pin, said first seal moveably engaging said cylinder to limit oil flow thereby, said first seal being mounted on said piston to be below said intake and exhaust ports when said piston is at a top of its stroke within said bore;

a second seal mounted on and circumferentially around said piston below said wrist pin, said second seal being positioned between said first seal and said crankcase, said second seal moveably engaging said cylinder to substantially prevent any oil flow thereby into said crankcase, said second seal being mounted on said piston to be in contact with said cylinder when said piston is at a bottom of its stroke within said cylinder, said first and second seals cooperating with said piston and said cylinder to define an annular oil chamber moveable with said piston for lubricating said cylinder;

a first conduit extending between said oil reservoir and a first port within said cylinder in fluid communication with said annular oil chamber for receiving pressurized oil from said oil reservoir, said first port being positioned so as to always be between said first and second seals regardless of the position of said piston within said bore; and a second conduit for returning oil from said annular oil chamber to said oil reservoir, said second conduit extending between a second port within said oil sleeve in fluid communication with said annular oil chamber and said oil reservoir, said second part being positioned so as to always be between said first and second seals regardless of the position of said piston within said bore.

22. A two-stroke internal combustion engine according to claim 21, wherein said oil reservoir is segregated from said crankcase.

23. A two-stroke internal combustion engine according to claim 21, wherein said main bearing is positioned within said oil reservoir and is lubricated by any oil therein.

24. A four-stroke internal combustion engine comprising:

a cylinder having a bore in communication with intake and exhaust ports;

a piston reciprocal within said bore;

a crankcase;

a crankshaft rotatably mounted on a main bearing within said crankcase, said crankshaft having a throw;

a piston rod having a first end connected to said piston by a wrist pin, and a second end connected to said throw by a crank bearing;

an oil reservoir in fluid communication with said cylinder;

a compression ring mounted on and circumferentially around said piston above said wrist pin, said compression ring moveably engaging said cylinder to limit oil flow thereby;

a seal mounted on and circumferentially around said piston below said wrist pin, said seal being positioned between said compression ring and said crankcase, said seal moveably engaging said cylinder to substantially prevent any oil flow thereby into said crankcase, said compression ring and said seal cooperating with said piston and said cylinder to define an annular oil chamber moveable with said piston for lubricating said cylinder;

a first conduit extending between said oil reservoir and a first port of said cylinder in fluid communication with said annular oil chamber for receiving pressurized oil from said oil reservoir, said first port being positioned so as to always be between said compression ring and said seal regardless of the position of said piston within said bore; and a second conduit for returning oil from said annular oil chamber to said oil reservoir, said second conduit extending through said piston from a second port in fluid communication with said annular oil chamber to said piston rod and along said piston rod to said crank bearing and from said crank bearing to said oil reservoir.

25. A four-stroke internal combustion engine according to claim 24, wherein said first and second conduits further extend along said crankshaft to said main bearing, and wherein at least a portion of any oil flowing through said crankshaft lubricates said main bearing.

26. A four-stroke internal combustion engine according to claim 24, wherein said main bearing is positioned within said oil reservoir and is lubricated by any oil therein.

27. An internal combustion engine comprising:

a cylinder having a bore;

a piston reciprocable withing said bore;

a crankcase;

a crankshaft rotatably mounted on a main bearing within said crankcase, said crankshaft having a throw;

a piston rod having a first end connected to said piston by a wrist pin, and a second end connected to said throw by a crank bearing;

an oil reservoir in fluid communication with said cylinder;

a first seal mounted on and circumferentially around said piston above said wrist pin, said first seal moveably engaging said cylinder to limit oil flow thereby;

a second seal mounted on and circumferentially around said piston below said wrist pin, said second seal being positioned between said first seal and said crankcase, said second seal moveably engaging said cylinder to substantially prevent any oil flow thereby into said crankcase, said first and second seals cooperating with said piston and said cylinder to define an annular oil chamber moveable with said piston for lubricating said cylinder;

a first conduit extending from said oil reservoir through said crank to said crankshaft bearing, from said crank bearing along said piston rod to said wrist pin, and from said wrist pin to a first port in fluid communication with said annular oil chamber for receiving pressurized oil from said oil reservoir; and a second conduit for returning oil from said annular oil chamber to said oil reservoir, said second conduit extending from a second port in fluid communication with said annular oil chamber along said piston rod to said crank bearing along said crankshaft and from said crank bearing along said crankshaft to said oil reservoir.

28. An internal combustion engine according to claim 27, wherein said first and second conduits further extend along said crankshaft to said main bearing, and wherein at least a portion of any oil flowing through said crankshaft lubricates said main bearing.

29. An internal combustion engine according to claim 27, wherein said main bearing is positioned within said oil reservoir and is lubricated by any oil therein.

30. A method for lubricating an internal combustion engine, said method comprising:

supplying oil to an annular oil space defined between a cylinder having a bore and a piston reciprocable within said bore, and between first and second seals mounted on and circumferentially around said piston to moveably engage said cylinder, said second seal moveably engaging said cylinder to substantially prevent any oil flow thereby, said oil being supplied through a port positioned to remain between said first and second seals during operation of the engine; and moving said piston within said cylinder to lubricate said cylinder with oil supplied to said annular oil space.

31. The method of claim 30, further comprising the steps of:

moving said piston to pressurize air in a crankcase and store at least a portion of the pressurized air in a holding chamber; and admitting at least a portion of the pressurized air from the holding chamber into the cylinder for combustion.

32. The method of claim 31, further comprising the step of:

admitting ambient air into the cylinder for combustion, the ambient air being admitted into the cylinder before the pressurized air is admitted.

* * * * *